US005748169A

United States Patent [19]

Okumura et al.

[11] Patent Number: 5,748,169

[45] Date of Patent: May 5, 1998

[54] DISPLAY DEVICE

[75] Inventors: Haruhiko Okumura, Fujisawa; Goh Itoh, Tokyo, both of Japan

[73] Assignee: Kabushiki Kaisha Toshiba, Kawasaki, Japan

[21] Appl. No.: 615,161

[22] Filed: Mar. 12, 1996

[30] Foreign Application Priority Data

Mar. 15, 1995 [JP] Japan ..... 7-056091

[51] Int. Cl.[6] ..... G06G 3/36

[52] U.S. Cl. ..... 345/100; 345/98; 345/94; 345/90

[58] Field of Search ..... 345/98, 99, 100, 345/94, 95, 96, 90, 92, 93, 87, 88, 89, 101, 103; 348/790, 791, 792, 793; 349/33, 34, 37, 38, 39

[56] References Cited

U.S. PATENT DOCUMENTS 5,048,934 9/1991 Numas ..... 349/33

5,088,806 2/1992 McCartney et al. ..... 345/101

5,489,918 2/1996 Mosier ..... 345/101

FOREIGN PATENT DOCUMENTS 3-271795 12/1991 Japan .

*Primary Examiner*—Xiao Wu

*Attorney, Agent, or Firm*—Oblon, Spivak, McClelland, Maier & Neustadt, P. C.

[57] ABSTRACT

A display device comprises a plurality of address lines arranged in a horizontal direction, a plurality of signal lines, arranged in a vertical direction, for transmitting an image signal, a plurality of pixels, arranged in a matrix at intersections between the plurality of address lines and the plurality of signal lines, each pixel including a display element, and a switch element which is connected between a corresponding one of the plurality of signal lines and the display element and which is controlled to be on or off under control of a corresponding one of the plurality of address lines, and compensating means for supplying, through the corresponding one of the plurality of address lines to the display element, a compensation signal for compensating a change in potential applied to the display element.

33 Claims, 20 Drawing Sheets m1 FIELD m2 FIELD m3 FIELD m4 FIELD m5 FIELD m6 FIELD
N
N+1
N+2
N+3
N+4
N+5
N+6
⊕ : POSITIVE POLARITY
⊖ : NEGATIVE POLARITY

DISPLAY DEVICE

BACKGROUND OF THE INVENTION

1. Field of the Invention

The present invention relates to a display device, and more particularly to a driving circuit for driving a display panel.

2. Description of the Related Art

In recent years, display devices, particularly liquid crystal display devices, have higher resolution (a greater number of pixels) and the driving frequency has been increased. Under the circumstances, to lower the voltage for a driving IC to process high-speed signals, a common alternating driving for altering the potential of a common electrode to the polarity opposite to that of an image (Jpn. Pat. Appln. KOKAI Publication No. 55-28649) and power supply level shift driving for shifting the source voltage in accordance with the polarity of an image (Jpn. Pat. Appln. KOKAI Publication No. 6-12035) have been proposed.

However, in the common alternating driving, since a common electrode of a great capacity must be driven in a short period, e.g., 15 to 30 microseconds, it consumes a large amount of power. In the power supply level shift driving, since a source capacitor of a large capacity must be driven, an additional powerful driving circuit is required. Further, it is difficult to apply the above driving techniques to a method for driving a power source at a high speed, for example, polarity inversion on alternate dots. Therefore, they are limited at present to signal line polarity alternate driving. The signal line polarity alternate driving has a characteristic that the horizontal crosstalk due to increase of the resistance of the common electrode does not easily occur, even in a case of using a large screen. However, in the driving method, since vertical crosstalk due to a leakage from a TFT (thin film transistor) is liable to occur, the specification requirement for the TFT characteristic is strict.

To solve the above problems, a field alternate driving method has been proposed, in which a power source is fixed, while the polarity of a signal line is alternated every field by a switch provided in a driving IC (Jpn. Pat. Appln. KOKAI Publication No. 3-51887). However, even in this method, to achieve dot alternate driving (the combination of signal line alternate driving and address line alternate driving), since the polarity must be altered every line, the power consumption is increased.

As another method for reducing power consumption, a multi-field driving method (hereinafter referred to as an MF driving method) for decreasing the driving frequency is proposed (Jpn. Pat. Appln. KOKAI Publication No. 3-271795). The MF driving method is very effective to reduce plane flicker. However, since the holding time of an image signal is considerably long, the flicker component of a pixel (in general, on each line) is increased. As a result, a stripe in each field, in other words line crawling, is easily recognized, thus degrading a still image. Further, in the MF driving method in which the power consumption is reduced, since the holding time in a case of displaying a still image is much longer, the line flicker is increased, and the quality of the image is lowered.

SUMMARY OF THE INVENTION

An object of the present invention is to provide a low-power consuming display device for reproducing an image with little flicker.

To achieve the above object, a display device according to the present invention comprises:

a substrate;

a plurality of address lines arranged in a horizontal direction on the substrate;

a plurality of signal lines, arranged in a vertical direction on the substrate, for transmitting an image signal;

a plurality of pixels, arranged in a matrix at intersections between the plurality of address lines and the plurality of signal lines on the substrate, each pixel including a display element, and a switch element which is connected between a corresponding one of the plurality of signal lines and the display element and which is controlled to be on or off by a corresponding one of the plurality of address lines; and compensating means for supplying, through the corresponding one of the plurality of address lines to the display element, a compensation signal for compensating a change in potential applied to the display element.

The compensating means output as the compensation signal, a signal having a potential which varies stepwise in one of positive and negative directions with a lapse of time in a period in which the switch element is controlled to be off, in order to compensate a change in potential applied to the display element in a period in which the switch element is controlled to be on.

The compensating means may output as the compensation signal, a signal having a potential which varies linearly in one of positive and negative directions with a lapse of time.

The compensating means output as the compensation signal, a signal having a potential which varies in accordance with at least one of a polarity of the image signal supplied to the corresponding one of the signal lines, a potential thereof, and a position of the pixel in the matrix.

The compensating means may output as the compensation signal, a signal having a period of about 1/n (n=an integer) of that of a signal for driving the switch element.

It is preferable that the display device further comprise driver circuits for driving the plurality of address lines, each driver circuit including a sample-hold circuit for maintaining a value of the compensation signal to be stepwise.

The compensating means may output as the compensation signal, a signal in which at least one of an absolute value of the potential applied to the display element and a period of change of the potential is varied in accordance with an amount of light applied to the switch element.

The compensating means may output as the compensation signal, a signal in which at least one of an absolute value of the potential applied to the display element and a period of change of the potential is varied in accordance with a period in which the switch element is driven.

It is preferable that each pixel further comprise a capacitor element connected to the display element to store the image signal and a capacitor line for applying a potential to the capacitor element, and the compensating means supply the compensation signal to the capacitor line.

The capacitor line may be connected to one of the plurality of address lines, which is assigned to one of the plurality of pixels adjacent in the vertical direction.

According to the present invention, even if the switch element has a leakage current characteristic the same as that of the prior art, which may cause crosstalk or flicker, the flicker can be reduced by supplying a compensation signal to the pixels through the address lines. Therefore, the image quality is prevented from degrading by a method of lowering power consumption by increasing the signal holding time of the pixel (lowering the driving frequency), or even by using a device of an adverse leakage current characteristic.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 4A and 4B are diagrams showing flicker components in the MF driving method, in which FIG. 4A shows changes in pixel potentials in three fields in an overlapping manner and FIG. 4B shows a synthesized waveform of the potentials shown in FIG. 4A;

DETAILED DESCRIPTION OF THE PREFERRED EMBODIMENTS

Prior to describing embodiments of the present invention, the concept of the MF driving method devised by the present inventors will be described with reference to FIGS. 1A to 1F.

Figures 1A, 1B, 1C, 1D, 1E, 1F:
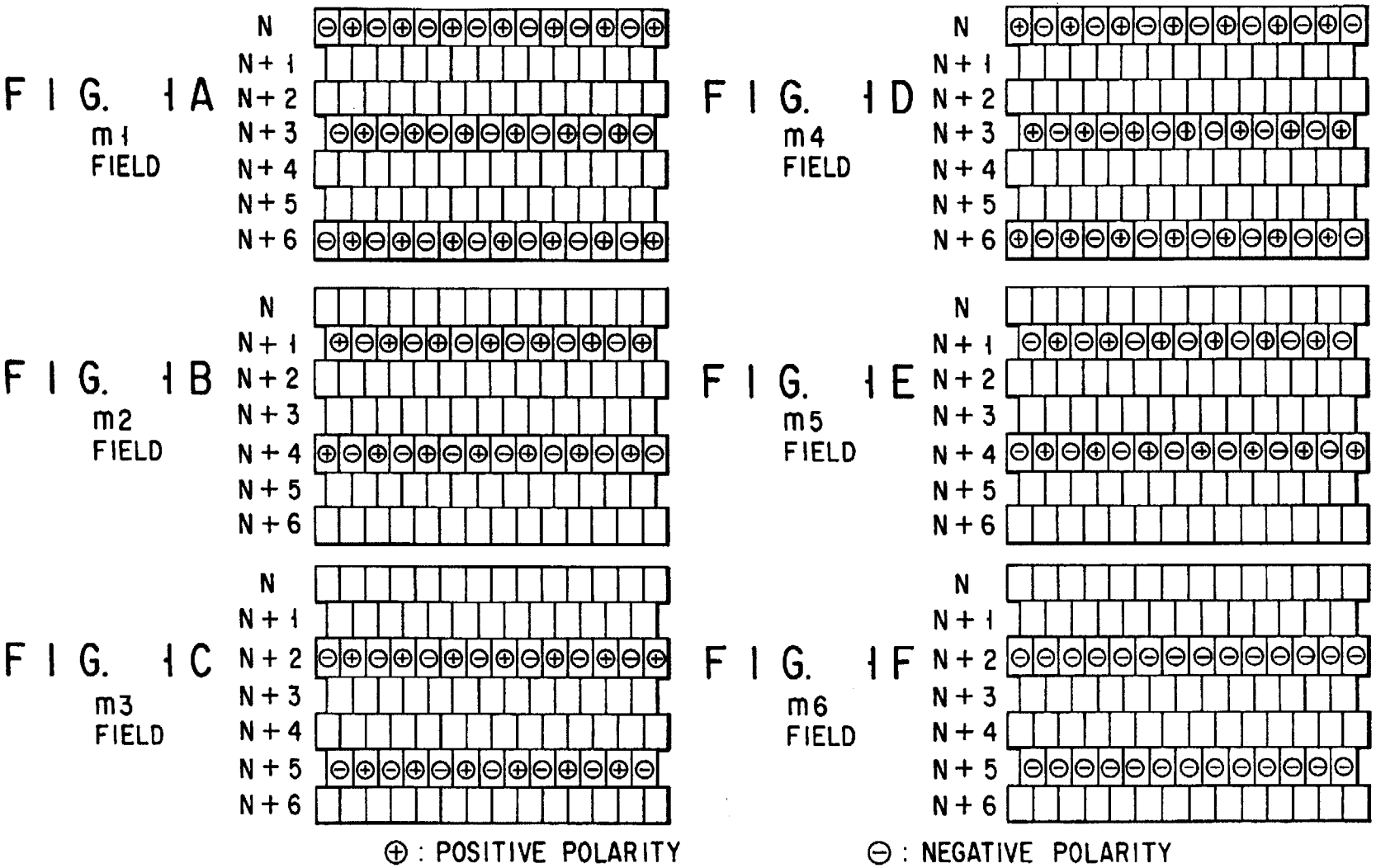
FIGS. 1A to 1F are diagrams for explaining the concept of the MF driving method, each showing the relationship between a gate line selection sequence and a voltage polarity.

First, a driving method, in a case where an m-th frame is displayed, will be described. In a first $T_s/3$ period ($T_s$ is a period in which a TFT samples an image signal), as shown in FIG. 1A, horizontal gate lines (address lines) N, N+3, N+6, . . . are driven. In this time, the polarities of signal lines are alternated: for example, positive image signals are supplied to the odd number-th signal lines of the vertical lines, whereas negative image signal lines are supplied to the even number-th signal lines.

In a second $T_s/3$ period, as shown in FIG. 1B, gate lines N+1, N+4, N+7, . . . are driven. In a third $T_s/3$ period, as shown in FIG. 1C, gate lines N+2, N+5, N+8, FIG. 1D, gate lines N, N+3, N+6, . . . are driven, like the first $T_s/3$ period, although the polarities of the signal lines are opposite to those in the first $T_s/3$ period. In this manner, alternate driving of liquid crystal cells is achieved. In the operations in the subsequent periods, as shown in FIGS. 1E and 1F, the polarities of the signal lines are opposite to those in the second and third T/3 periods shown in FIGS. 1B and 1C, respectively.

Flicker components in the aforementioned driving will now be analyzed. The following are considered to be factors of flicker:

(1) Insufficient ON current;

(2) Feed-through voltage of a TFT; and (3) OFF current of a TFT.

The above factors (1) and (2) can be dealt with by improving the array structure of a liquid crystal display panel or compensation driving. However, since, in principle, the MF driving is to make the holding time of a TFT longer than that in the conventional driving, if the OFF characteristic of the TFT, involving optical leakage, is not satisfactory, it may influence the flicker characteristic more adversely as compared to the other conventional driving method. For this reason, the factor (3) will be primarily analyzed.

Figure 2:
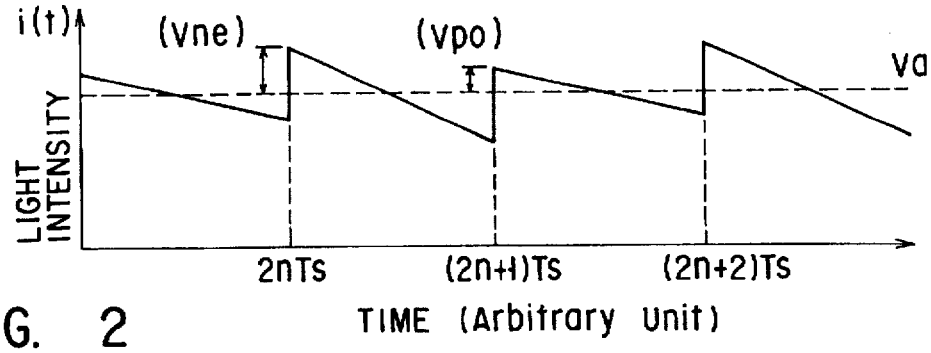
FIG. 2 is a waveform diagram showing a time-series change of a pixel potential in the MF driving method.

A ramp waveform shown in FIG. 2 approximates a time-series change of light intensity of a pixel. The change of light intensity is similar to a change in pixel voltage applied to a liquid crystal element. The horizontal dot line in FIG. 2 represents the average light intensity corresponding to an average pixel voltage $V_a$. When the pixel is driven in the positive polarity, since the signal holding characteristic of the pixel is satisfactory, the light intensity, compensated at a sample-hold period switching time (e.g., $(2n+1)T_s$) with a pixel potential $V_{p0}$, is gradually lowered during 1 sample-hold period ($T_s$). When the pixel is driven in the negative polarity, since the signal holding characteristic is poor, the light intensity, corrected at a sample-hold period switching time (e.g., $2nT_s$) with a pixel potential $|V_{NE}|$ ($>|V_{p0}|$), is lowered at a greater rate. The time-series change i(t) of the light intensity at this time is given by the following equation:

$$i(t) = \begin{cases} VS + VN - \dfrac{2VNt}{\pi} & (0 \leqq t < \pi) \\ VS + VP - \dfrac{2VPt}{\pi} & (-\pi \leqq t < 0) \end{cases} \tag{1}$$

The light intensity in an actual liquid crystal panel is obtained by multiplying the above change by the response characteristic of the liquid crystal on time axis. However, since the response characteristic is a complex characteristic which varies depending on a potential level, only the potential change is analyzed in the following description as a factor of the change in light intensity.

The equation (1) is Fourier-transformed into the following equation:

$$i(t) = VS + \frac{1}{\pi}\sum_{k=1}^{\infty}\frac{2}{k^2\pi}(1-(-1)^k)\times (VN-VP)\sin kt + \frac{1}{k}(1+(-1)^k)\times (VN+VP)\cos kt \tag{2}$$

Considering only a basic component of a flicker, the following equation is obtained (where k=1):

$$F1 = \frac{4}{\pi^2}(VN-VP) \tag{3}$$

Figure 3:
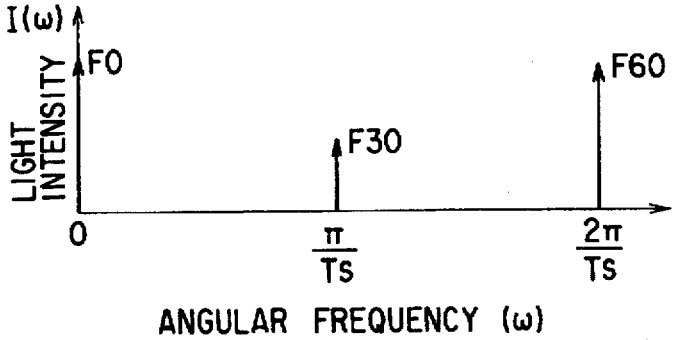
FIG. 3 is a diagram showing a flicker component of a pixel in the MF driving method.

Each pixel has, as a flicker component, a spectrum F30 at a frequency of 30 Hz, which is relatively visible, as shown in FIG. 3. The flicker component can be removed by the following methods:

(1) To increase the frequency of the change in the light intensity i(t) itself; and (2) To compensate a flicker by an adjacent pixel.

The method (1) is not usually employed, since an image signal is processed at a high speed in the method and a great amount of power is consumed or additional frame memories are required, thereby enlarging circuit structure. The method (2) includes line inversion (common inversion) and signal line inversion. The method (2) will be described in detail.

In either method, since signals of opposite polarities are input to pixels adjacent to each other, an average light intensity ia(t) of the two adjacent pixels is expressed by the following equation:

$$i(a)t = i(t) + i\left(t - \frac{\pi}{\omega_0}\right) \quad \left(\omega_0 = \frac{\pi}{Ts}\right) \tag{4}$$

The equation (4) is Fourier-transformed into the following equation:

$$Ia(\omega) = I(\omega)\left(1 - \exp\frac{j\omega\pi}{\omega_0}\right) \tag{5}$$

According to the above equation, $Ia(\omega_0)=0$. Thus, the flicker component is completely removed.

The above description relates to a case in which two compensation pixels are used. When an N-number of compensation pixels are used, an average light intensity ia(t) of the N-number of adjacent pixels and a Fourier-transformed value Ia(ω) are expressed by the following equations:

$$ia(t) = \sum_{n=0}^{N-1} i\left(t + \frac{n}{N}\times\frac{2\pi}{\omega_0}\right) \tag{6}$$

$$Ia(\omega) = \sum_{n=0}^{N-1} I(\omega)\exp\frac{j\frac{n}{N}\,\omega 2\pi}{\omega_0} \tag{7}$$

Figure 4A:
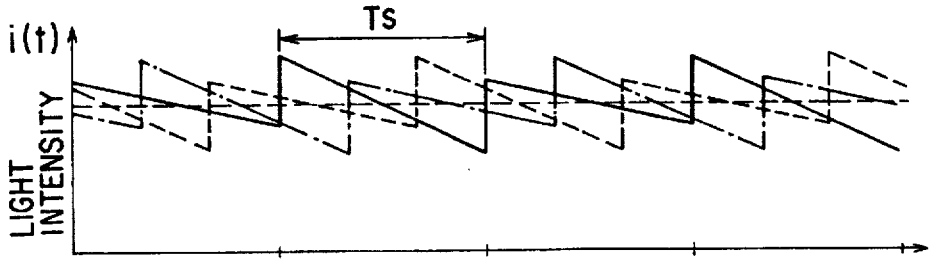
Figure 4B:
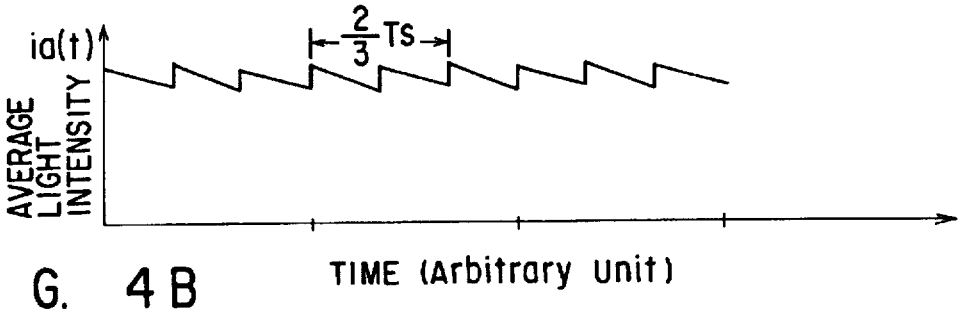
Figure 5:
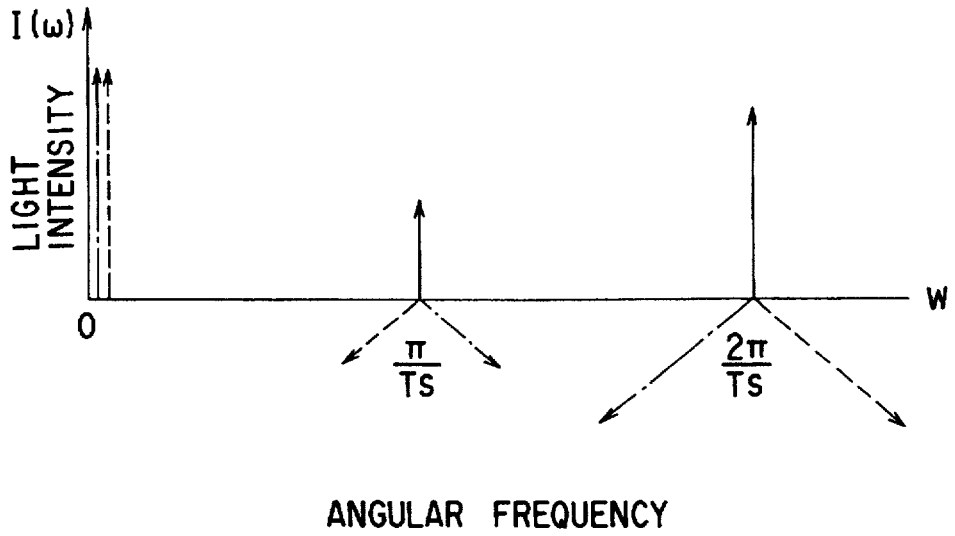
FIG. 5 is a diagram showing a frequency spectrum of a change in light intensity of a pixel.

A case of compensating a flicker component in three pixels will now be described. In FIG. 4A, time-series changes i(t) of light intensities of the three pixels obtained by the above equation (6) are respectively indicated by the solid line, the chain line, and the broken line. FIG. 4B shows the average light intensity ia(t) of the intensities shown in FIG. 4A. A frequency spectrum is shown in FIG. 5.

As clear from FIGS. 4A and 4B, if the time-series changes i(t) of the light intensities of pixels, compensated with each other, have the same waveform, the flicker component of $2T_s$ can be reduced to $2T_s/3$ by compensation in the three pixels. More specifically, if $T_s$ is 50 ms (the frequency of revising the screen is 20 Hz), the flicker of 100 ms can be reduced to 100/3 ms, in which case, the flicker is less visible. Further, if the signal line polarity alternate driving or address line polarity alternate driving is combined, the frequency component can be halved to 50/3 ms, and therefore, further less visible. In terms of the frequency spectrum, the phases of the spectrums of the pixels are shifted 120° from one another, as clear from the equation (7). It follows that the vectors of the spectrums are added, thereby eliminating the flicker component. On this principle, a flicker component can be compensated in odd number-th pixels (third, fifth, seventh, . . . (2N+1)th pixels). The greater the number of pixels used to compensate, the lower the driving frequency. Therefore, the power consumption is much reduced.

Based on the analysis of the MF driving, an experiments on the effect of reducing flicker were executed by means of an actual panel. In the experiments, the following three methods were compared:

(1) Conventional driving (60 Hz, non-interlace, signal line inversion (2) Conventional driving with a lower frequency (20 Hz)

(3) MF driving (N=1; 3 fields)

In the respective methods, a gray level of the transmission rate of 50% is displayed and the time-series change of the light intensity is detected by a photodetector. The time-series change of the light intensity is converted to a frequency component by an FFT (Fast Fourier Transform) analyzer. Contents of basic waveform components, i.e., 20 Hz, 40 Hz and 60 Hz components, were analyzed and evaluated.

Table 1 shows the results of measurement of the level of frequency components relative to an average light intensity of a flicker component in the conventional 60 Hz driving, the conventional 20 Hz normal driving and the MF driving (N=1).

TABLE 1

| Driving Method | Frequency Components of Flickers (dB) 20 Hz | 40 Hz | 60 Hz | 80 Hz |
|---|---|---|---|---|
| MF Drive | −53 | | −41 | |
| Conventional 60 Hz Drive | −51 | | −39 | |
| Conventional 20 Hz Drive | −26 | −34 | −41 | −45 |

The following matters are understood from Table 1.

(1) In the conventional 20 Hz driving, 20 Hz, 40 Hz and 60 Hz components were generated, as expected.

(2) In the MF driving, 20 Hz components were eliminated and converted to 60 Hz components of the frequency of three times. (In each pixel, there are flickers of a level equivalent to that in the 20 Hz driving. However, flickers in adjacent pixels are compensated and the result as shown in Table 1 is obtained.)

(3) The 60 Hz components of the conventional 60 Hz driving (signal line polarity alternate driving) are the same level as that of the MF driving. Image degradation due to flickers is substantially the same in the conventional 60 Hz driving and the MF driving.

As described above, although the MF driving is very effective for eliminating plane flicker, the level of flicker components in the respective pixels (normally, on one line) is as great as that in the 20 Hz driving in Table 1, since the holding time of an image signal is considerably long in the MF driving. Therefore, horizontal stripes in each field are visible, so that the quality of a still image is degraded.

The present invention has been made to overcome the above problems. Prior to explaining embodiments, the basic concept of the present invention will be described with reference to FIGS. 6 to 12.

Figure 6:
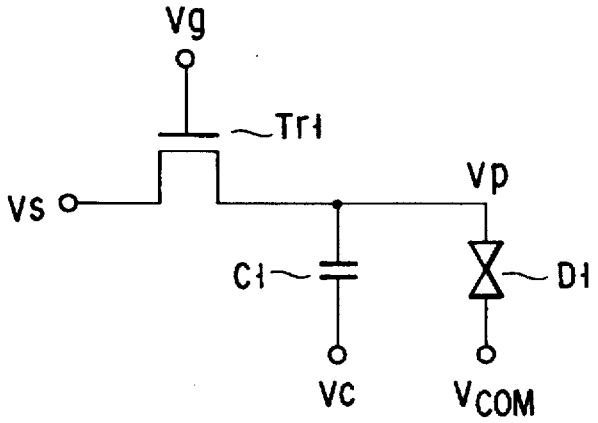
FIG. 6 is a diagram showing an equivalent circuit of a pixel of a liquid crystal display device.

FIG. 6 shows a basic circuit configuration of a liquid crystal pixel. The pixel comprises a sample hold circuit, for holding a voltage $V_p$, including a transistor $Tr_1$ serving as a switch and a capacitor element $C_1$. The object of this invention is to obtain an only little amount of the voltage $V_p$ reduced due to a leakage current in the holding time.

Figure 7:
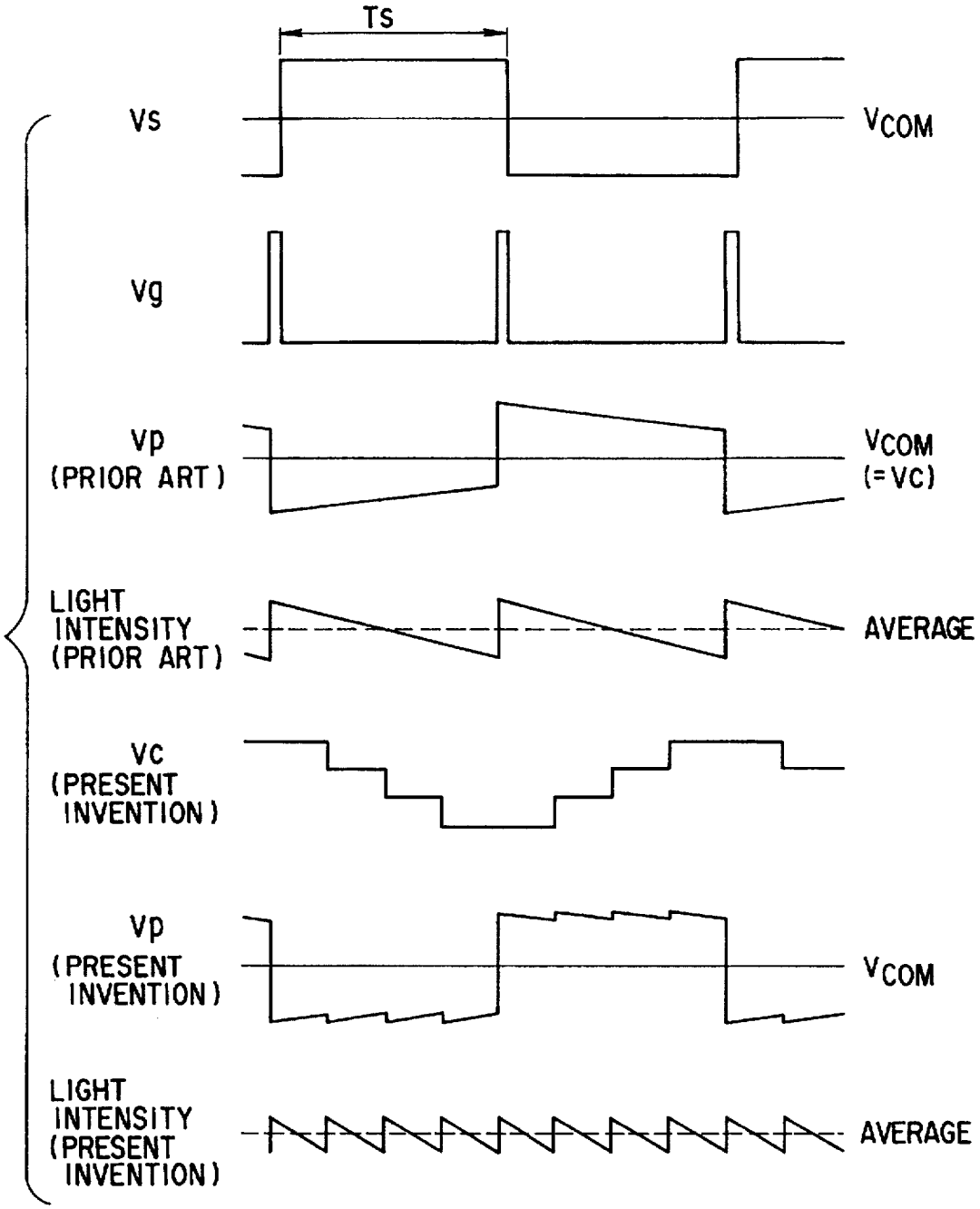
FIG. 7 is a signal waveform diagram for explaining the basic concept of the present invention.

FIG. 7 is a waveform diagram for explaining an operation of the circuit shown in FIG. 6. A signal input $V_s$ to an input terminal of the transistor $T_{r1}$ is sampled in synchronism with a pulse signal $V_g$ applied to the gate of the transistor $T_{r1}$, and stored in the capacitor element $C_1$. "$T_s$" denotes a sampling period.

Figure 8:
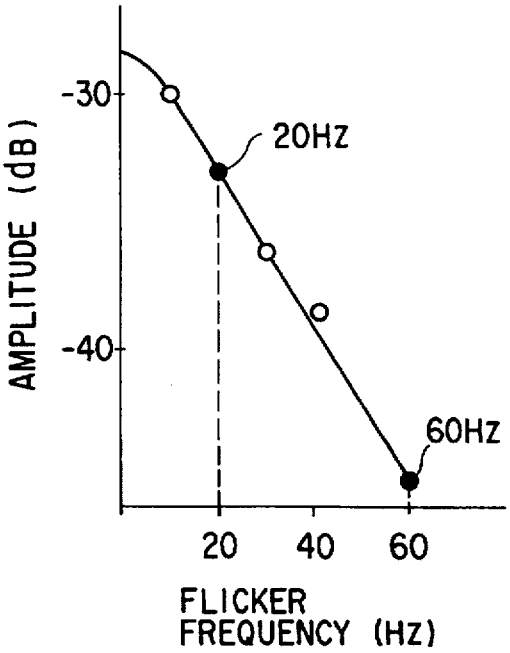
FIG. 8 is a diagram showing the relationship between a flicker frequency and a flicker amplitude, for explaining the optical transmission characteristic of a liquid crystal element.
Figure 9:
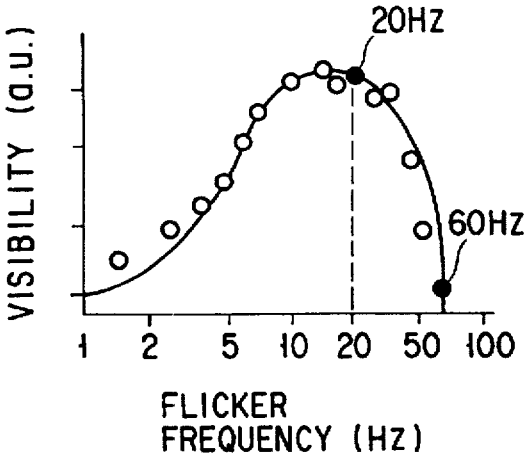
FIG. 9 is a diagram showing the relationship between a flicker frequency and visibility.

The voltage $V_p$ stored in the capacitor element $C_1$ is a voltage (pixel voltage) applied to a liquid crystal element $D_1$. According to the conventional art, the voltage $V_p$ is gradually reduced due to a leakage current. Assuming that the sampling period is $T_s$, the pixel potential changing period is also $T_s$. In this case, the longer the period $T_s$, the greater the change of the potential. Therefore, the change in transmittance or light intensity of the liquid crystal is also greater in terms of period and degree. Even if the amount of leakage current is reduced, if the period is longer (e.g., the frequency is 20 Hz), the liquid crystal molecules can respond to the change in light intensity. This is because the period corresponds to a portion in which a low-pass characteristic of the liquid crystal element is high, as shown in FIG. 8. FIG. 9 is a diagram showing the relationship between a flicker frequency and human visibility. Since the visibility is very high at the frequency of 20 Hz, flicker is visible very much. For this reason, according to the prior art, the flicker can be reduced by increasing the frequency (e.g., 60 Hz). However, in this case, there is another problem that a great amount of power is consumed.

In contrast, according to the present invention, a step-like compensation signal $V_c$ as shown in FIG. 7 is supplied from the capacitor element $C_1$ to the pixel during one sampling period ($T_s$), thereby reducing the degree of change of the pixel potential and increasing the frequency of the pixel potential change. In FIG. 7, since the correction is performed in a period of $T_s/4$, the period of pixel potential change (light intensity change) is reduced to ¼ (the frequency is four times) and the degree of the change is also reduced to ¼. Further, in view of the optical transmission characteristic shown in FIG. 8 and the visibility characteristic shown in FIG. 9, it is understood that when the frequency is increased, both the characteristics are suddenly lowered. Therefore, the flicker is apparently much less than ¼.

Figure 10:
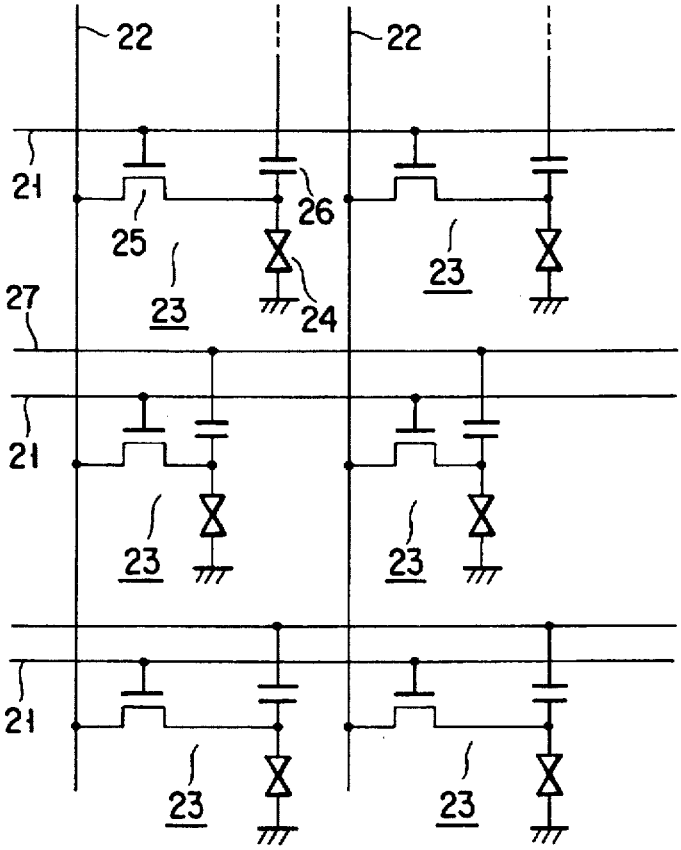
FIG. 10 is a diagram showing the basic circuit configuration of a liquid crystal display panel according to the present invention.

The above explanation relates to one liquid crystal pixel. The overall crystal panel has a structure as shown in FIG. 10. In the liquid crystal panel, pixels 23 are respectively arranged at intersections between a plurality of gate lines (address line) 21 arranged in the horizontal direction and a plurality of signal lines 22 arranged in the vertical direction. Each pixel 23 comprises a liquid crystal cell 24, a TFT (thin film transistor) 25 for selecting the liquid crystal cell 24, and a capacitor element 26 for holding a voltage. The capacitor element 26 is connected between the liquid crystal cell 24 and a compensating signal line 27.

Figure 11:
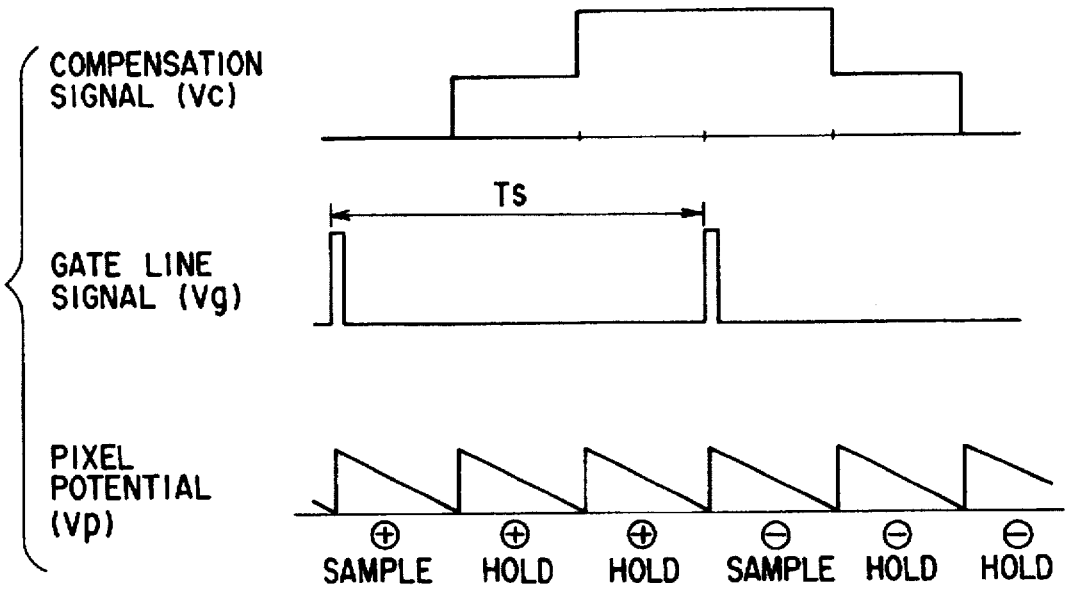
FIG. 11 is a signal waveform diagram for explaining the basic concept of a flicker compensating method of the present invention.
Figure 12:
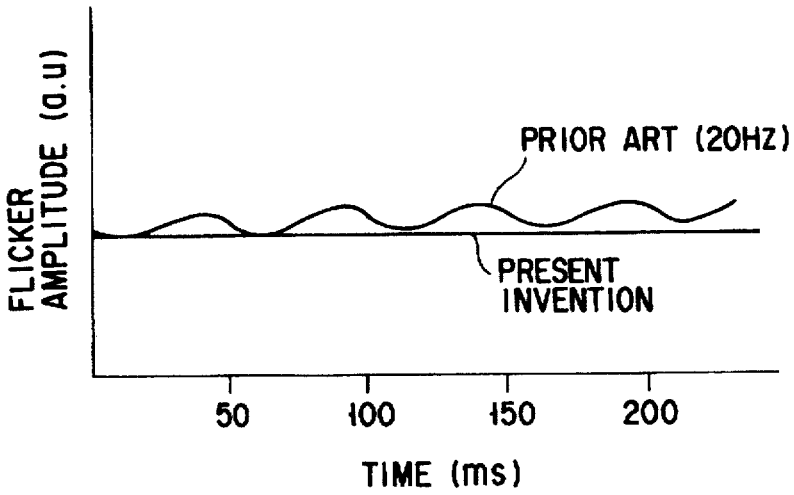
FIG. 12 is a diagram showing a difference between flicker amplitudes according to the present invention and prior art.

FIG. 11 is a signal waveform diagram in a case where a compensating operation is performed in the above liquid crystal panel in a period ⅓ of the sampling period. The correcting operation is the same as that as shown in FIG. 7. The changes in pixel voltage and light intensity can be increased three times that in the case of sampling. As a result, flicker becomes substantially invisible as indicated in the graph of FIG. 12.

As described above, the capacitor element for holding a voltage is compensated, so that the change in light intensity due to leakage from the switching element or the change in pixel voltage can be reduced in terms of both period and degree.

The liquid crystal display device according to embodiments of the present invention will be described below with reference to FIGS. 13 to 26.

(First Embodiment)

Figure 13:
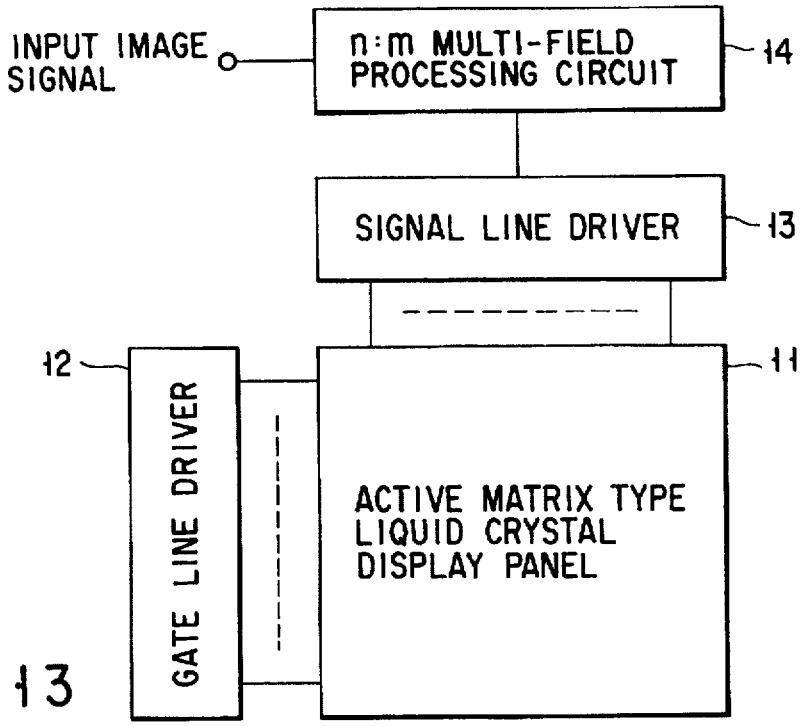
FIG. 13 is a block diagram of a liquid crystal display device according to a first embodiment of the present invention.

FIG. 13 is a block diagram showing the overall structure of a liquid crystal display device according to a first embodiment of the present invention. The liquid crystal display device of this embodiment, having an n:m multi-field processing function, comprises an active matrix type liquid crystal display panel 11, a gate line driver 12, a signal line driver 13 and an n:m multi-field processing circuit 14.

The n:m multi-field processing function is, in the MF driving which reduces power consumption, to divide one frame into an n-number of fields and display an image of an m-number of fields.

Figure 14:
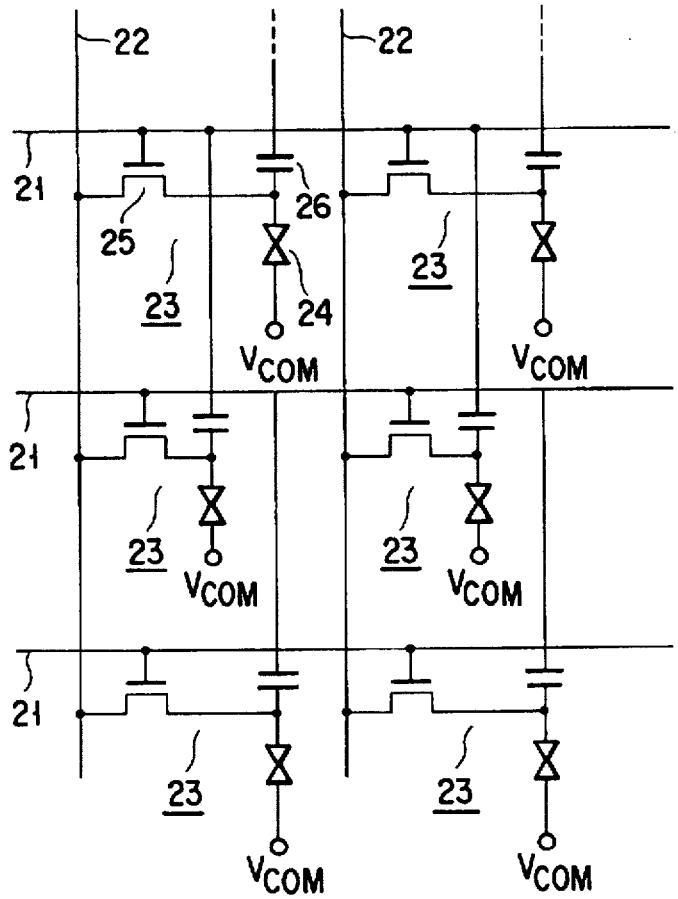
FIG. 14 is a circuit diagram showing the circuit configuration of a liquid crystal display panel of the liquid crystal display device shown in FIG. 13.

FIG. 14 is a circuit diagram showing in detail the structure of the liquid crystal display panel 11. In the liquid crystal panel, pixels 23 are respectively arranged at intersections between a plurality of gate lines (address lines) 21 arranged in the horizontal direction and a plurality of signal lines 22 arranged in the vertical direction. Each pixel 23 comprises a liquid crystal cell 24, a TFT (thin film transistor) 25 for selecting the liquid crystal cell 24, and a capacitor element 26 for holding a voltage. The capacitor element 26 is connected between the liquid crystal cell 24 and the preceding (next previous) gate line 21.

The gate line driver 12 selectively drives the gate lines 12 of the liquid crystal display panel 11. The n:m multi-field processing circuit 14 converts an input image signal to an MF driving signal by sub-sampling the input image signal. The signal line driver 13 selectively supplies the signal converted by the n:m multi-field processing circuit 14 to the signal lines 22 of the liquid crystal display panel 11.

Figure 15:
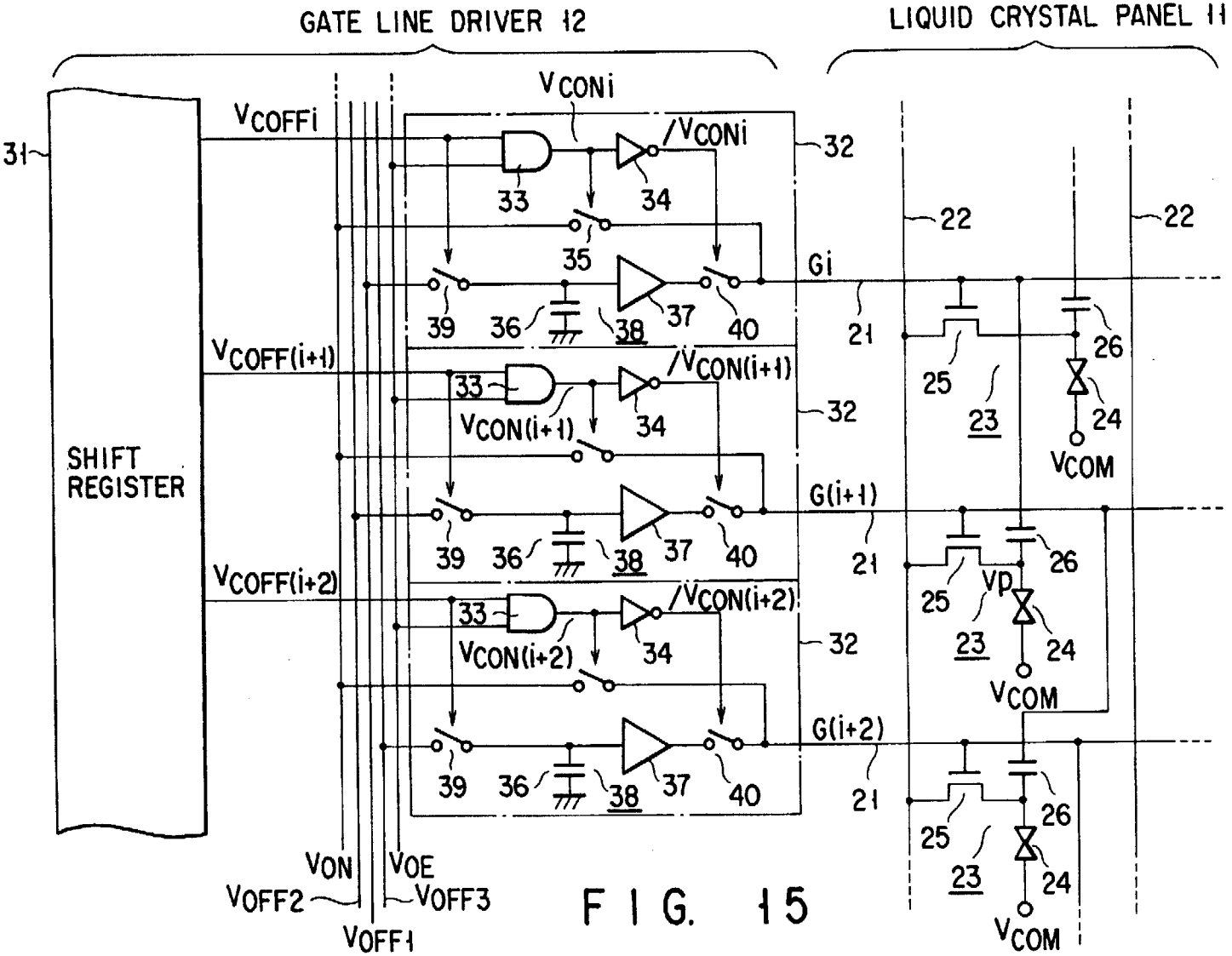
FIG. 15 is a circuit diagram showing part of the internal configuration of a gate line driver of the liquid crystal display device shown in FIG. 13 and part of the liquid crystal display panel.

FIG. 15 is a circuit diagram showing part of the internal configuration of the gate line driver 12 and part of the liquid crystal display panel 11. The gate line driver 12 comprises a shift register 31 and driver circuits 32 corresponding to the respective gate lines 21 of the liquid crystal display panel 11.

Each of the driver circuits 32 supplies a signal to the corresponding gate line 21 in selection time and non-selection time. The driver circuit 32 comprises an AND gate 33, an inverter 34, a switch 35, a sample-hold circuit 38 constituted by a capacitor 36 and a buffer 37, a switch 39 and a switch 40. One end of the AND gate 33 receives the corresponding output ($V_{COFFi}$, $V_{COFF(i+1)}$, . . . ) from the shift register 31, and the other end thereof receives an enable signal $V_{OE}$. The inverter 34 inverts an output from the AND gate 33. The switch 35 is connected between the corresponding gate line 21 and a selection signal line to which a selection time signal $V_{ON}$ is supplied when the corresponding gate line 21 is selected. The switch 35 is turned on or off in accordance with the output from the AND gate 33. The switch 39 is connected between an input of the sample-hold circuit 38 and a compensation signal line to which a compensation source signal $V_{OFF1}$, $V_{OFF2}$, or $V_{OFF3}$ is supplied when the corresponding gate line 21 is not selected. The switch 39 is turned on or off in accordance with the corresponding output ($V_{COFFi}$, $V_{COFF(i+1)}$, . . . ) from the shift register 31. The switch 40 is connected between an output from the sample-hold circuit 38 and the corresponding gate line 21. The switch 40 is turned on or off in accordance with an output ($V_{CONi}$, $V_{CON(i+1)}$, . . . ) from the inverter 34.

Figure 16A:
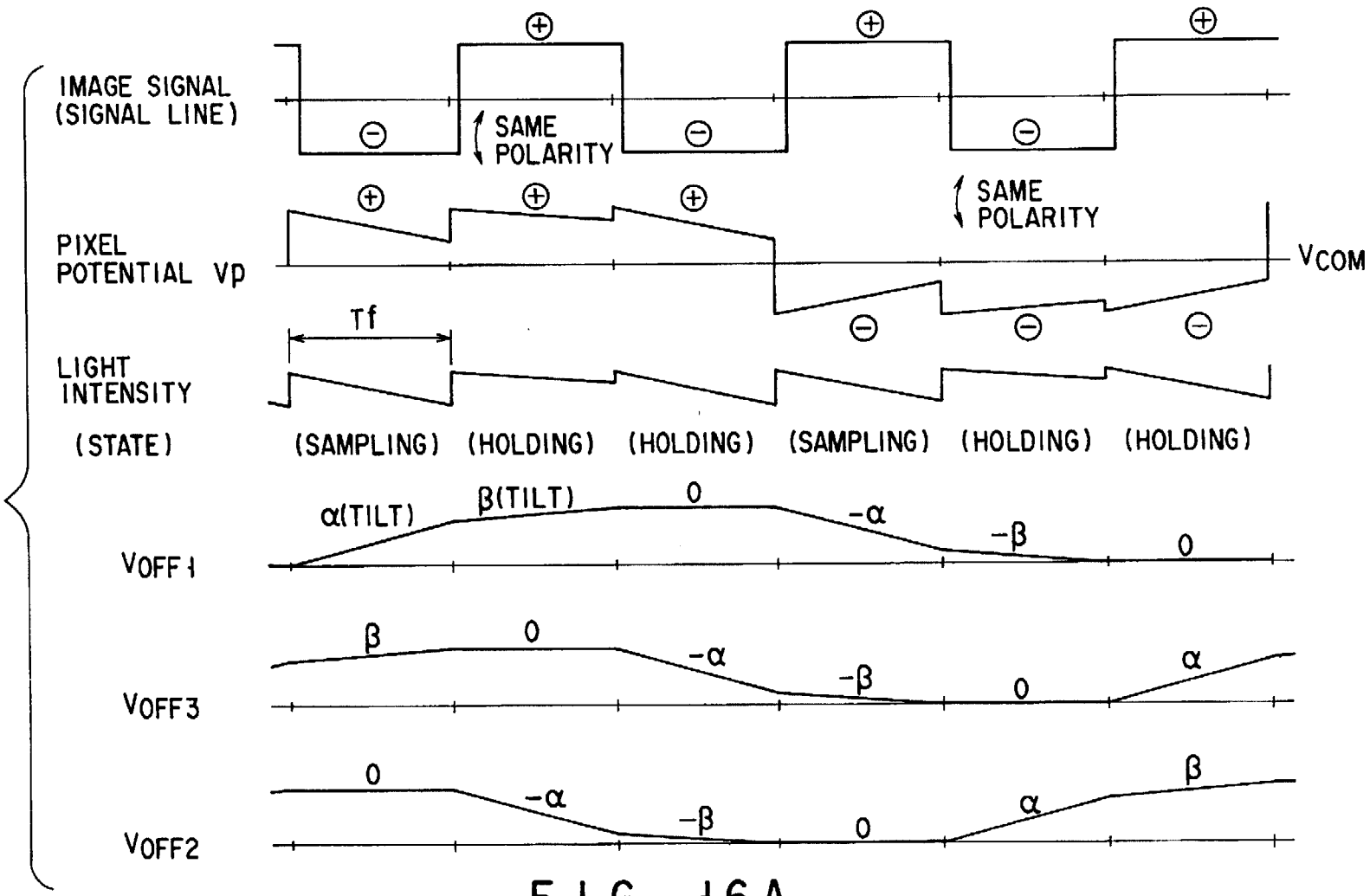
FIGS. 16A and 16B are signal waveform diagrams, on the same time axis, at portions of the liquid crystal display device according to the first embodiment.
Figure 16B:
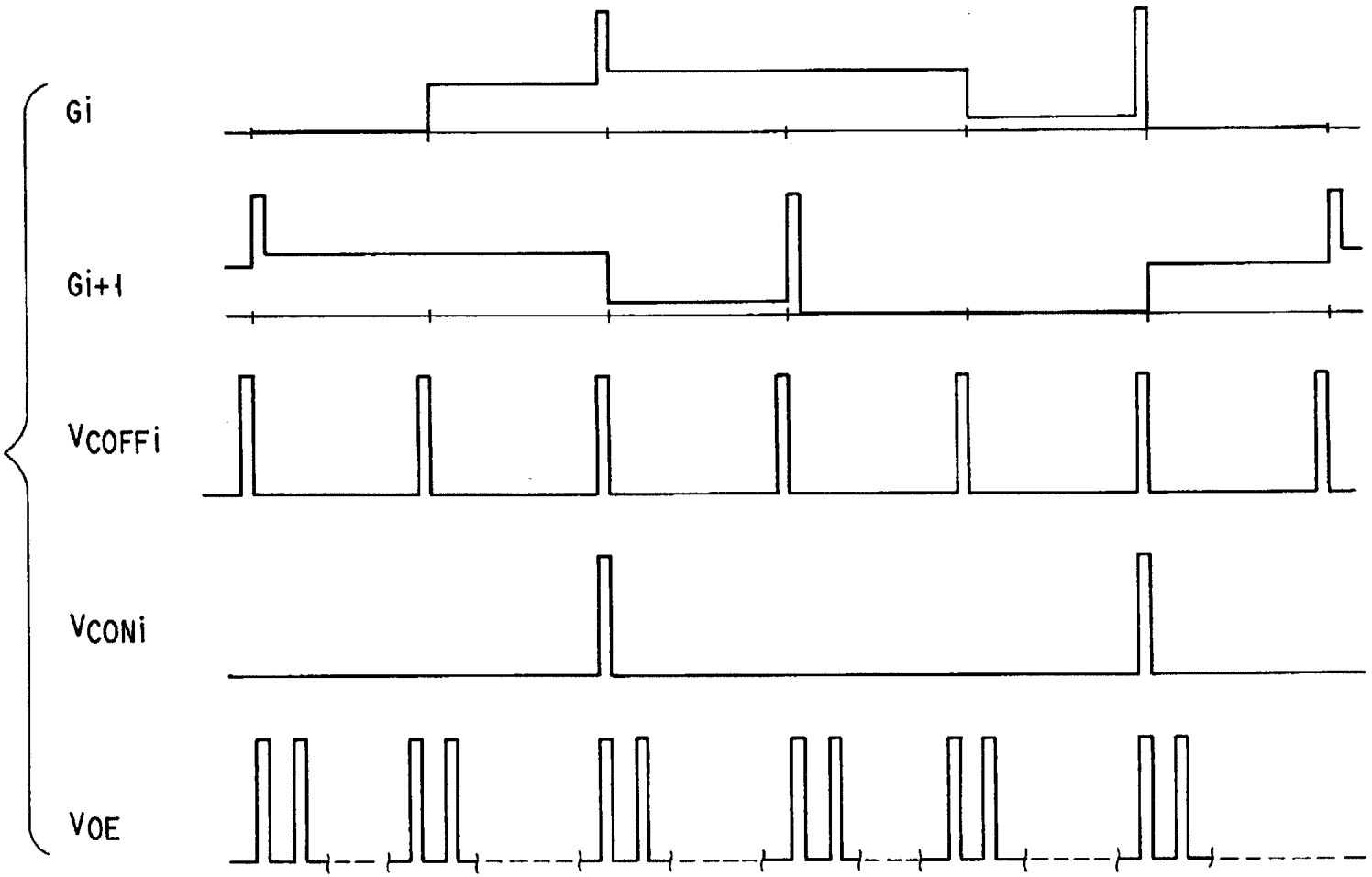

An operation of the liquid crystal display device of this embodiment will be described with reference to waveform diagrams shown in FIGS. 16A and 16B. FIGS. 16A and 16B show signal waveforms on the same time axis in a case of 3:1 multi-field processing. In this case, different gate lines are selected in three fields: that is, lines 1, 4, 7, 10 . . . are selected in a first field, lines 2, 5, 8 . . . are selected in a second field and lines 3, 6, 9 . . . are selected in a third field. Thus, all the gate lines in the three fields, thereby forming one frame. The field period is indicated by "$T_f$". An image signal is supplied by a field alternate driving method in which the polarity of the signal driven is alternated every field.

In a selection period when the gate line 21 is driven by the corresponding driver circuit 32 in the gate line driver 12, an image signal on the corresponding signal line 22 is written into the liquid crystal cell 24 through the TFT 25. For example, when the output $V_{COFF(i+1)}$ from the shift register 31 is on "H" level and the enable signal $V_{OE}$ is on "H" level, the output from the AND gate 33 is on "H" level and the switch 35 is on. As a result, the selection time signal $V_{ON}$ is output to the corresponding gate line 21 (G(i+1) in FIG. 15), thereby turning on the TFTs 25 of the pixels 23 on one line. At this time, the image signal supplied to the signal line 22 is written as the pixel signal $V_P$ through the TFT 25 into the liquid crystal cell 24 of each of the pixels 23 on the line. Since the pixels 23 on this line are selected after two field-periods, the pixel signal $V_p$ written in the liquid crystal cell 24 leaks, as shown in FIG. 16A, through the TFT 25 in a holding period in which the image signal is stored.

According to the present invention, a compensation signal is supplied in the holding period to the liquid crystal cell 24 through the capacitor element 26 from the preceding gate line 21, thereby compensating the image signal (a privately-made compensating line having the same function is provided for the uppermost gate line).

More specifically, a driving signal is supplied to the gate lines to be driven in the field (every third line in this embodiment). On the other hand, a compensation signal is supplied to the gate lines which are not driven. The polarity of the compensation signal corresponds to the polarity of the voltage stored in the liquid crystal cell 24. In other words, when the polarity of the voltage stored in the liquid crystal cell is positive, the direction of the leakage is negative. On the other hand, when the polarity is negative, the direction of the leakage is positive. Therefore, the compensation is performed in the direction opposite to that of the leakage. In addition, since the leakage generally varies depending on the position in the screen of the liquid crystal display panel, compensation source signals ($V_{OFF1}$, $V_{OFF2}$ and $V_{OFF3}$ in FIG. 16A), having different values depending on the positions in the screen, are supplied to the gate line drivers 12 of this embodiment. More specifically, the lower the position in the screen, the greater the leakage of the switch element, since a voltage is applied for a longer period of time to the switch element connected between the signal line whose signal polarity has been inverted and the liquid crystal element having a potential whose polarity has not been inverted. Accordingly, the compensation voltage is gradient so as to be higher at the lower position of the screen. In FIGS. 14 and 15, $V_{COM}$ represents a potential of a common electrode of the liquid crystal element.

Assume that a positive image signal is written into pixels 23 on one line connected to the gate line 21 (G(i+1)) at the beginning of one field period ($T_f$). When the output $V_{COFFi}$ from the shift register 31 becomes "H" level in the next one field period, the switch 39 is turned on, with the result that the compensation source signal $V_{OFF1}$ is supplied to and sampled by the sample-hold circuit 38. In this case, as shown in FIG. 16A, the value of the compensation source signal $V_{OFF1}$ is varied in accordance with the position in the screen (the elapse of time). FIG. 16A shows a signal waveform in a pixel in a lowermost portion of the screen. In this period, since the signal $V_{CONi}$ output from the inverter 34 is on "L" level, the switch 40, which is low-active, remains closed and the signal $V_{OFF1}$ sampled by the sample hold circuit 38 is output to the gate line 21 (Gi). The signal $V_{OFF1}$ is supplied to the liquid crystal cell 24 through the capacitor element 26 in the pixel 23. The potential of the image signal $V_p$ stored in the pixel 23 is therefore temporarily increased (in the case of a positive potential) or decreased (in the case of a negative potential), and then decreased or increased due to leakage. In the next one field period, when the output $V_{COFFi}$ from the shift register 31 becomes "H" level again, the switch 39 is turned on. Then, in the same manner as described above, the compensation source signal $V_{OFF1}$ is supplied to and sampled by the sample-hold circuit 38. In this period, since the signal $V_{CONi}$ output from the inverter 34 is still on "L" level, the switch 40 remains closed. The signal $V_{OFF1}$ (higher than the voltage sampled in the preceding period), sampled by the sample-hold circuit 38 is output as a compensation signal to the gate line 21 (Gi), and a voltage corresponding to the difference between the present sampled voltage and the preceding sampled voltage is applied to the liquid crystal cell 24 through the capacitor element 26. The potential of the image signal $V_p$ stored in the pixel 23 is therefore, as shown in FIG. 16A, temporarily increased or decreased, and then decreased or increased due to leakage. Thus, as shown in FIG. 16A, the light intensity of each pixel is high in the beginning of every field period and lowered with the lapse of time in the period.

When the polarities of the image signal and the pixel signal are the same, the compensation voltage can be low, since the leakage through the TFT 25 is little. On the other hand, when the polarities are different, a higher compensation voltage is required. For this reason, the compensation source signals $V_{OFF1}$ to $V_{OFF3}$ have different gradients (α, β and 0) in the respective fields. The signals $V_{OFF1}$, $V_{OFF3}$ and $V_{OFF2}$ are shifted from each other by one field period $T_f$.

In general, an n-channel TFT is used as the TFT 25 in each pixel 23. However, if the n-channel TFT approximates to a p-channel TFT, a pixel voltage $V_h$ in a holding time is given by the following equation, where $V_d$ represents a drain voltage of the TFT, $V_g$ represents a gate voltage, and $V_t$ represents a threshold voltage:

$$V_h=V_d+2(V_0-V_d)(V_d+V_t-V_g)P/\{(V_0-V_d)(1-P)+2(V_d+V_t-V_g)\} \quad (8)$$

Assuming that $C_t$ is the sum of the capacitance $C_{LCD}$ of the liquid crystal cell 24 of the pixel 23 and the capacitance $C_s$ of the capacitor element 26, and $V_0$ is an initial value of an image signal stored in the liquid crystal cell 24, the following relationships are established:

$$P=\exp(\beta\alpha t/C_t)$$

$$\alpha=-2(V_d+V_t-V_g)$$

$$\beta=(W/L)C_g\mu/2$$

$$C_t=C_{LCD}+C_S$$

(W is the channel width of the TFT, L is the channel length, $C_g$ is the gate capacitance and μ is a mobility of a carrier).

If the leakage current of the TFT is little, the value of $\beta\alpha t/C_t$ is substantially 0. Therefore, the value of P approximates to that of $(1-\beta\alpha t/C_t)$.

In this time, the following relationship is established:

$$(V_0-V_d)(1-P)<<2(V_d+V_t-V_g) \quad (9)$$

When the above relationship is substituted for the equation (1), the following equation is obtained:

$$V_h=V_d+(V_0-V_d)(1-\beta\alpha t/C_t) \quad (10)$$

Accordingly, the voltage ΔV, which is varied due to leakage, is obtained by the following equation:

$$\Delta V=(V_0-V_d)\beta\alpha t/C_tT_s \quad (11)$$

($T_s$ is a holding time).

Assuming that the compensation voltage is $V_{cg}$, if a compensation voltage which establishes the following relationships, the leakage can be compensated completely:

$$V_{cg}(C_s/C_t)=\Delta V=(V_0-V_d)\beta\alpha/C_tT_s \quad (12)$$

$$V_{cg}=(V_0-V_d)\beta\alpha/C_sT_s \quad (13)$$

When that portion of the equation (13) which does not depend on the voltage is replaced with γ, the above equation (13) can be revised as follows:

$$V_{cg}=-\gamma(V_0-V_d)(V_d+V_t-V_g) \quad (14)$$

$$(\gamma=(2\beta/C_s)T_s).$$

Therefore, if the above compensation voltage is applied to the capacitor element as a compensation signal in accordance with the voltage $V_d$ of the signal 22, the leakage current can be completely compensated. To supply the same compensation voltage to all the pixels on one line from the gate line 21, the leak characteristics of the TFTs 25 of the pixels 23 of the line must be the same. Otherwise, the leakage in all the pixels cannot be completely compensated. However, this problem influences little to improvement of the image quality of the liquid crystal display device of this embodiment, since leakage is conspicuous in a gray display, and not conspicuous in a pattern formed by signals of high frequencies.

As described above, according to the present invention, the image signal $V_p$ stored in the pixel varies every field as shown in FIG. 16A. As a result, the light intensity varies as if every field is driven.

In this manner, in contrast to the prior art in which the period of leakage is 6Tf (2Ts), substantially all the components of the period of 6Tf are eliminated, whereas flickers of the period Tf are increased. Since the frequency of flickers, however, is 60 Hz in general, the flickers are hardly visible. Moreover, the optical transmission characteristics of the liquid crystal are considerably degraded (1/10 or less than that in the case of 10 Hz). Hence, there is substantially no problem about the flickers (see FIGS. 8 and 9). In other words, according to this embodiment, the leakage of the image signal stored in the pixel is reduced. In addition, the change of the final light intensity is reduced by increasing the frequency of the change. The device of the embodiment as a whole is much advantageous in flicker reducing effect as compared to the prior art in which leakage is reduced by simply improving the device characteristics.

In the above embodiment, the value of the compensation signal is changed stepwise as indicated by the waveform Gi in FIG. 16B. However, the value may be changed linearly, as will be described later.

(Second Embodiment)

A second embodiment of the present invention will be described. In this embodiment, the display device is driven in an interlacing manner as in the first embodiment: that is, every third line is driven. The polarity of the image signal varies every field. Therefore, the structures shown in FIGS. 13 to 15 also apply to this embodiment.

Figure 17:
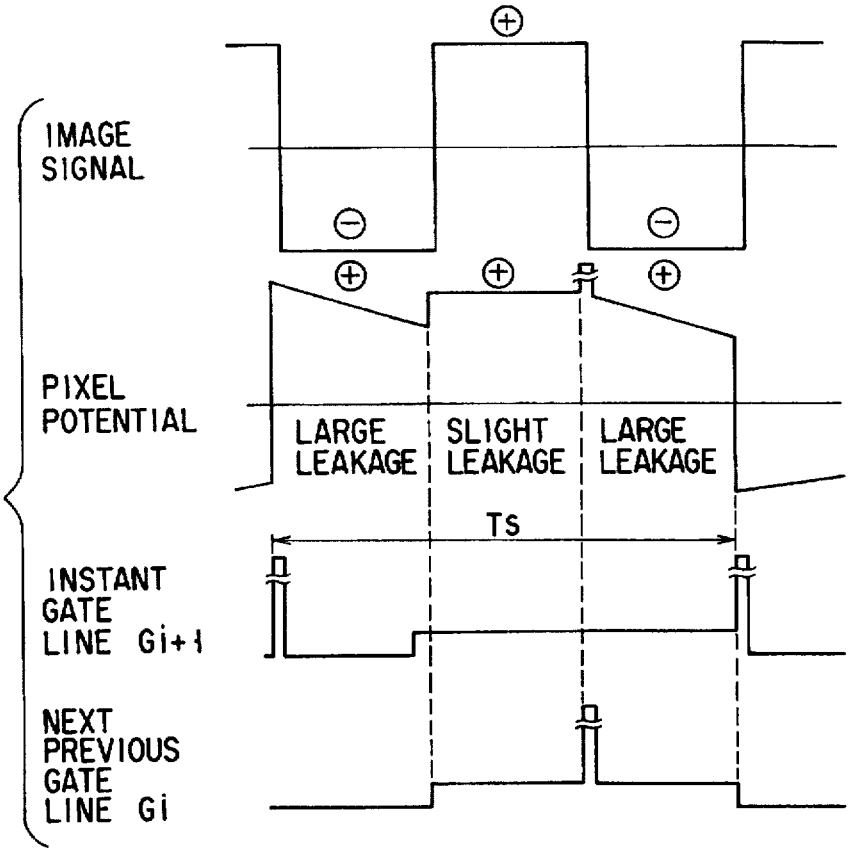
FIG. 17 is a diagram showing signal waveforms at portions of a liquid crystal display device according to a second embodiment of the present invention.

When the gate lines are driven in this manner, a potential difference, which results in leakage, is generated every other field between a signal line and a pixel. More specifically, as shown in FIG. 17, in a lower portion of the screen, the polarities of the signal line and the pixel are opposite to each other in a first field period (a large amount of leakage), they are the same polarities in a second field period (a small amount of leakage), and they are opposite in a third field period (a large amount of leakage). Thus, leakage is involved in the pixel signal in the first and third field period. For this reason, the compensation value of the compensation signal must be changed every line, depending on whether the polarities of the pixels on the line and the signal line are the same or opposite. In other words, if the polarities are the same in a field and leakage is very little, the next field does not require compensation. In contrast, if the polarities are opposite, the next field is subjected to the maximum compensation. In this embodiment, since the leakage is very little in the second field as shown in FIG. 17, the compensation signal Gi is not changed in the second and third fields.

Thus, the magnitude of the compensation signal can be determined in accordance with the state of the leakage in the preceding field.

(Third Embodiment)

A third embodiment of the present invention will now be described. This embodiment has a structure as shown in FIGS. 14 and 15; however, the display device is driven at 60 Hz in a non-interlacing manner, yet showing flickers due to large leak current. As shown in the waveform diagram of FIG. 18, when a half a field period has elapsed since the gate line was driven in the field, a compensation signal is applied to the preceding (next previous) gate line. The pixel electrode is compensated through the capacitor element connected to the next previous gate line, the period of a flicker is halved and the amplitude is also halved.

Figure 18:
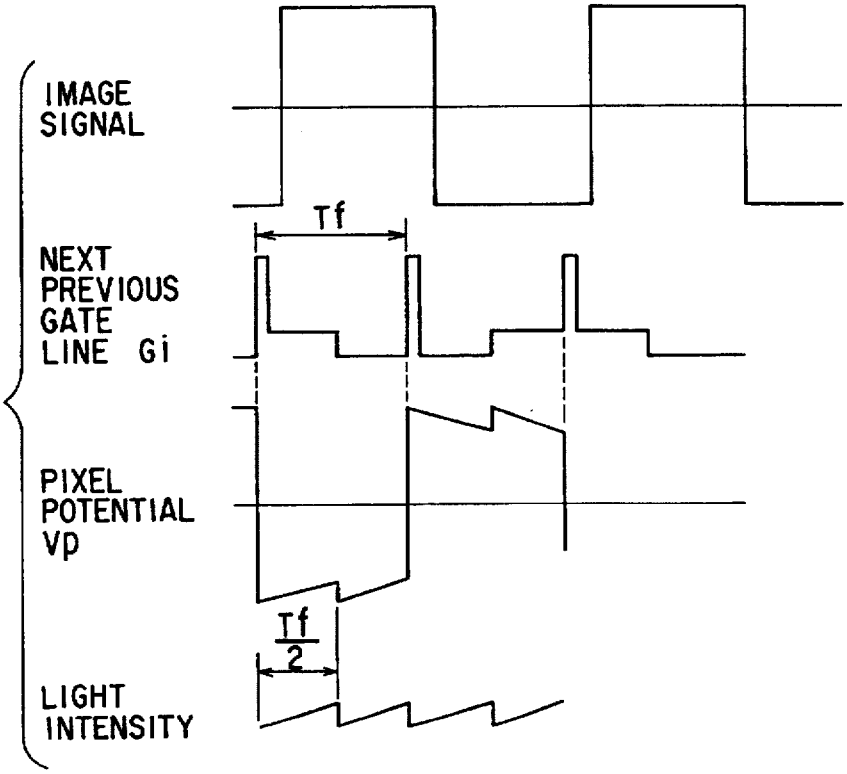
FIG. 18 is a diagram showing signal waveforms at portions of a liquid crystal display device according to a third embodiment of the present invention.

Although compensation is performed in a ½ of the field period in the embodiment as shown in FIG. 18, it can be performed in a period of 1/n (n=an integer), such as ⅓ or ¼, to increase the frequency of flickers. Thus, flickers can be inconspicuous even with large leakage by increasing flicker frequency.

In the above embodiments, the change in holding voltage, when the pixel voltage is off, varies depending on the position in the screen (an upper portion or a lower portion). Therefore, a compensation source signal $V_{OFF}$ having a ramp-shaped waveform is input, sample-held in accordance with the position in the screen, and used as a compensation signal actually supplied to the capacitor element. The compensation can be performed by the aforementioned array structure in the field or line alternate driving where same polarity signals are input in each signal line. However, in the signal line or dot polarity alternate driving where different polarity signals are input in each signal line, since the pixels driven by the same gate line must be of the same polarity, it is necessary to modify the array structure. Such an example will be described below.

(Fourth Embodiment)

Figure 19:
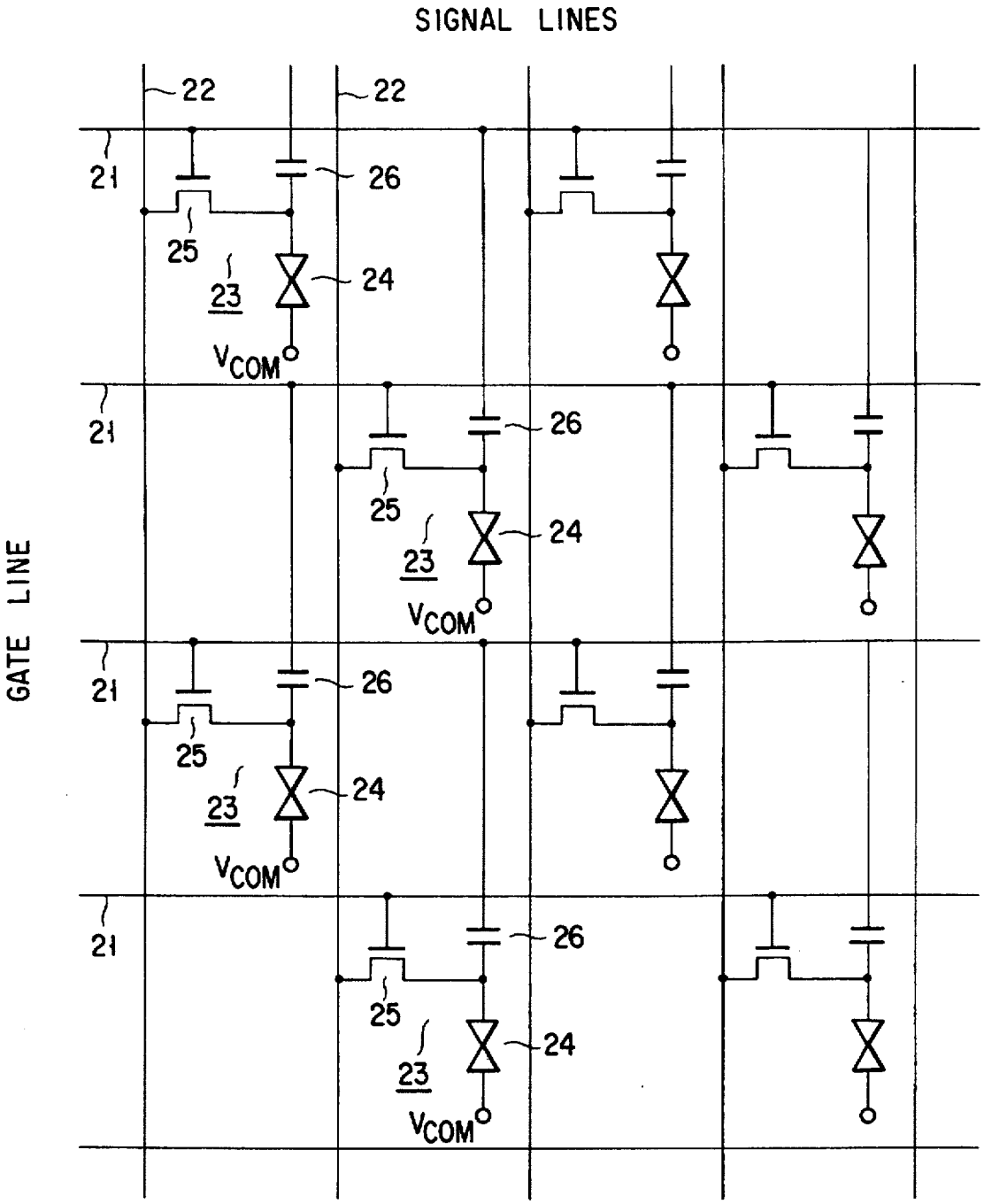
FIG. 19 is a circuit diagram showing pixel arrangement and a method of interconnecting gate lines and pixels of a liquid crystal display device according to a fourth embodiment of the present invention.

FIG. 19 is a circuit diagram showing a panel portion of a liquid crystal display device according to a fourth embodiment of the present invention. The same elements as shown in FIG. 14 are identified with the same reference numerals as used in FIG. 14 and detail descriptions thereof will be omitted. The compensation can be performed by the aforementioned array structure in the field alternate driving. However, since the device of this embodiment is driven in the signal line polarity alternate driving, pixels must be connected to the gate lines alternately every other signal lines, as shown in FIG. 19. With this structure, although gate lines of the number twice that used in the array structure are required, the horizontal crosstalk, inherent to the signal line polarity alternate driving, and flickers due to the polarity difference (positive and negative) are reduced. Thus, a high quality image can be expected.

However, in the above method, since the gate driver requires sample-hold circuits of the number twice that used in the first embodiment, the gate driver itself is inevitably expensive (if the gate drivers are formed integral with the panel made of polysilicon, this problem does not arise).

In contrast, in the common alternate driving or polarity inversion on alternate dots, since the holding characteristics are the same in the upper and lower portions of the screen, compensation can be achieved by a constant OFF voltage, not a ramp-shaped waveform. In this case, no sample-hold circuit is required. Such an example will be described below.

(Fifth Embodiment)

Figure 20:
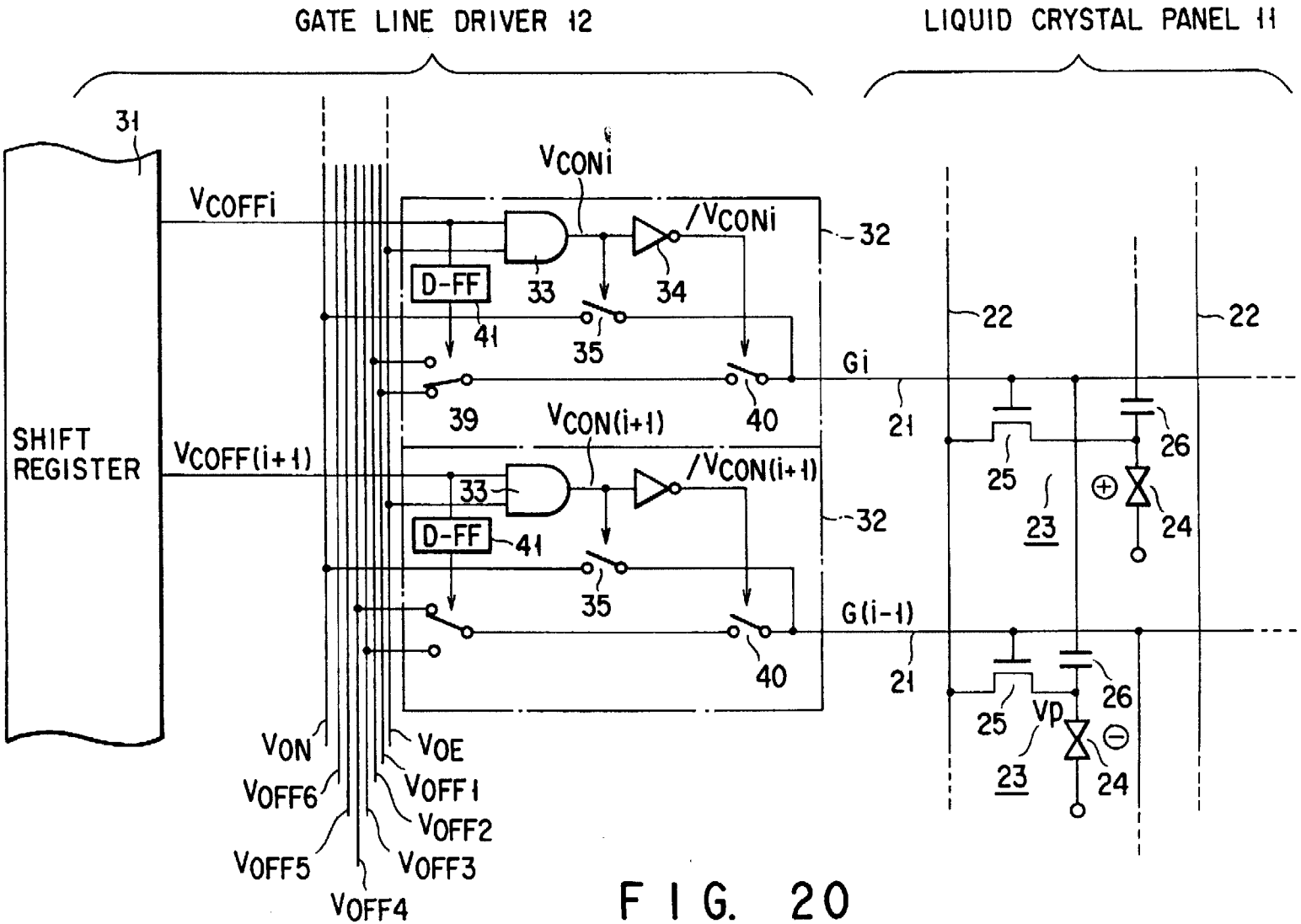
FIG. 20 is a circuit diagram showing part of the internal configuration of a gate line driver of a liquid crystal display device and part of a liquid crystal display panel according to a fifth embodiment of the present invention.

FIG. 20 is a circuit diagram showing the structure of a gate line driver of a liquid crystal display device according to a fifth embodiment of the present invention. The same elements of the first embodiment as shown in FIG. 15 are identified with the same reference numerals as used in FIG. 15 and detail descriptions thereof will be omitted. The structure of the liquid crystal panel is the same as that of FIG. 14.

In this embodiment, the gate driver has six lines ($V_{OFF1}$–$V_{OFF6}$), to which a compensation source signal can be input. These lines can be switched only by selecting switches. More specifically, the lines $V_{OFF1}$ and $V_{OFF2}$, the lines $V_{OFF3}$ and $V_{OFF4}$, and the lines $V_{OFF5}$ and $V_{OFF6}$ are respectively paired, so that the compensation voltage of a pixel driven by a positive or negative signal can be determined. Although the lines $V_{OFF5}$ and $V_{OFF6}$ are not connected to any line in FIG. 20, they are actually connected to a gate line G (i+2) (not shown). Since either polarity produces the same effect, an example of one polarity in the case of the lines $V_{OFF1}$ and $V_{OFF2}$ will be described below.

Figure 21A:
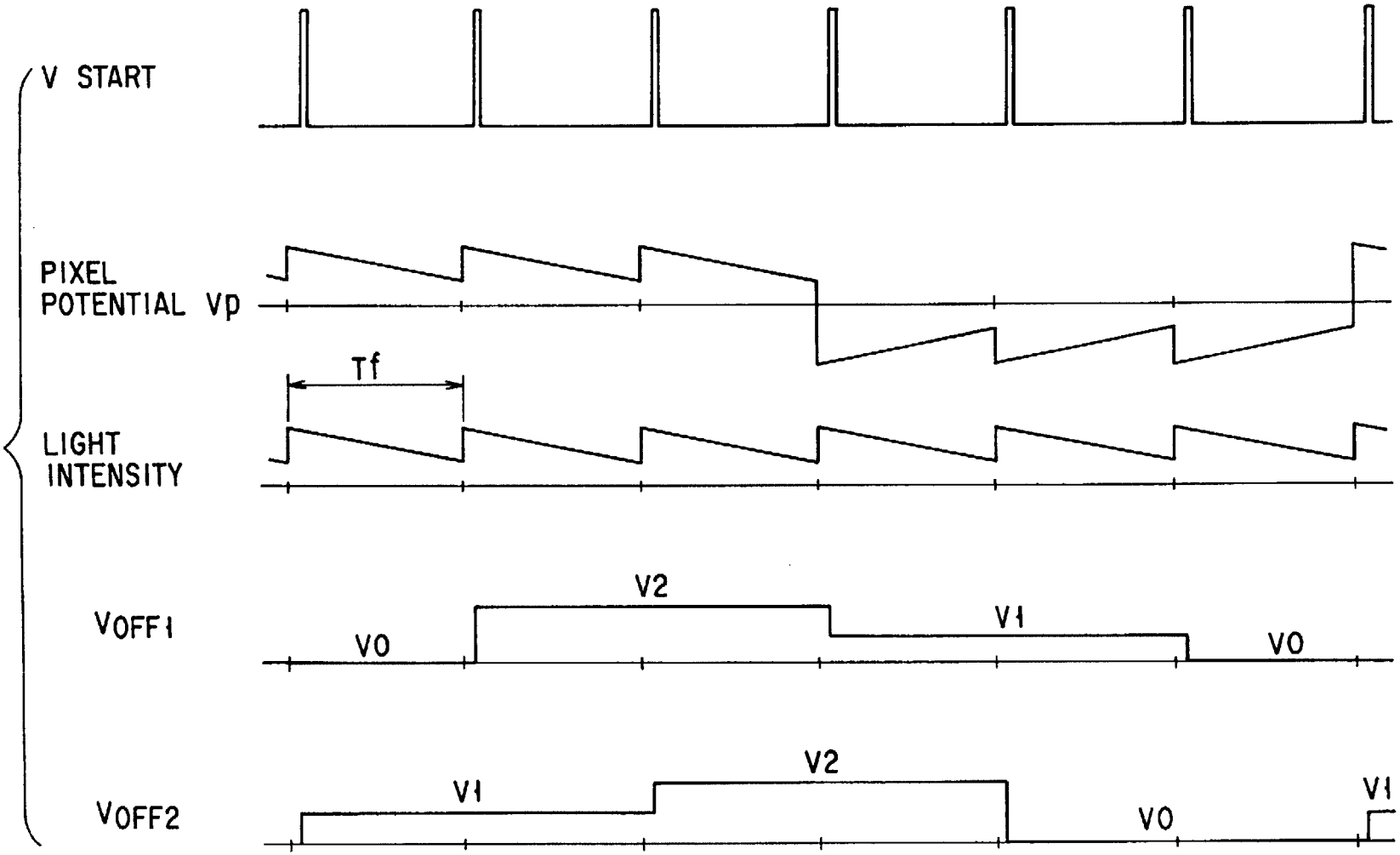
FIGS. 21A and 21B are signal waveform diagrams, on the same time axis, at portions of a liquid crystal display device according to a fifth embodiment of the present invention.
Figure 21B:
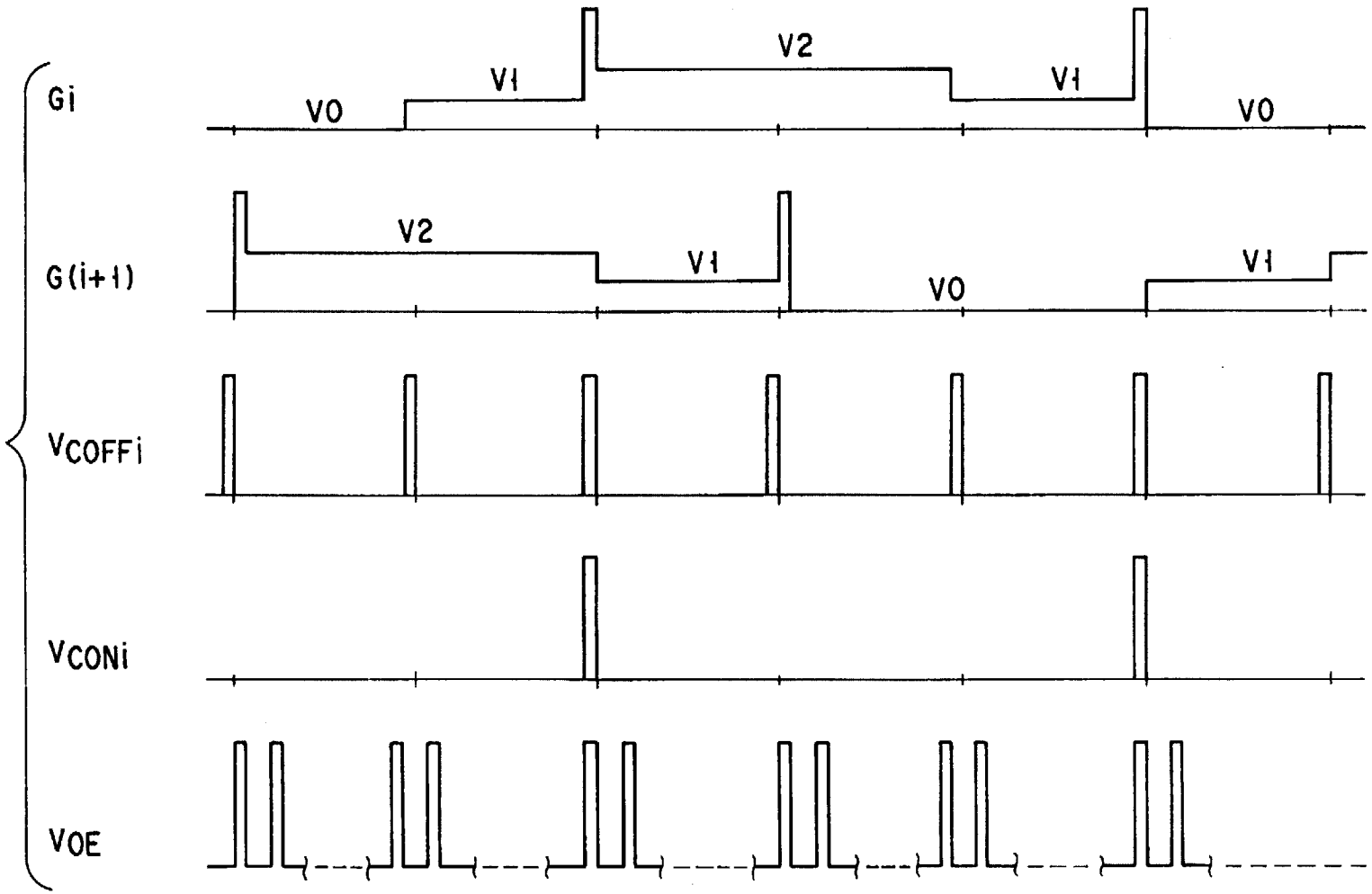

FIGS. 21A and 21B are timing charts showing the signals in the two gate lines Gi and G(i+1) in the lowermost portion of the screen. In FIG. 21A, a signal $V_{start}$ means a start of vertical synchronization of the screen, indicating that scanning is started from the top of the screen at a timing of H level. Since the timing chart of FIG. 21A relates to the gate line near the lowermost portion of the screen, the signal $V_{start}$ rises with some delay after the timings of the change in the gate lines Gi and G(i+1). The voltage in the line $V_{OFF1}$ or $V_{OFF2}$ is changed at the timing of the signals $V_{start}$, and a compensation source signal having a step-like waveform of the levels $V_0$, $V_1$ and $V_2$ is input. Since the timing of selective output is different in upper and lower portions of the pixel, the signal is supplied to the lines $V_{OFF1}$ and $V_{OFF2}$, such that the voltages of the three levels overlap with one another in the lines, as shown in FIG. 21A. The line $V_{OFF1}$, and $V_{OFF2}$ are alternately selected by a D-type flip flop 41 through the switch 39 at the timing of $V_{COFFi}$. The value of the selected line is output as a Gi (compensation) signal to the gate line 21 through the switch, which is normally on (L active). A signal which is one field (Tf) shifted from Gi, is output to the next gate line as a signal G(i+1).

In a case of common alternate driving (line alternate driving), it is possible to compensate flickers which occur due to difference between the holding voltage characteristics (positive and negative) in relation to adjacent two lines. Therefore, even if change in light intensity in a line of the positive polarity is different from that in a line of the negative polarity, the flickers can be compensated.

In the above embodiments, the TFT array has a structure in which the capacitor elements 26 are connected to the preceding gate line. However, an exclusive compensation signal line, other than the gate line, may be provided. Further, a compensation voltage may be applied to the liquid crystal element by any other means instead of the capacitor element.

Furthermore, the optical leak current generated in a TFT varies depending on the amount of backlight in a transmission type display panel and the amount of ambient light in a reflecting type display panel. In other words, the more the light, the more the leak. Therefore, change in pixel potential, i.e., the light intensity, is increased. In the following embodiment, to solve this problem, the amount of backlight or ambient light is detected and the amount of compensation or the compensation frequency is changed in accordance with the detected result.

(Sixth Embodiment)

Figure 22:
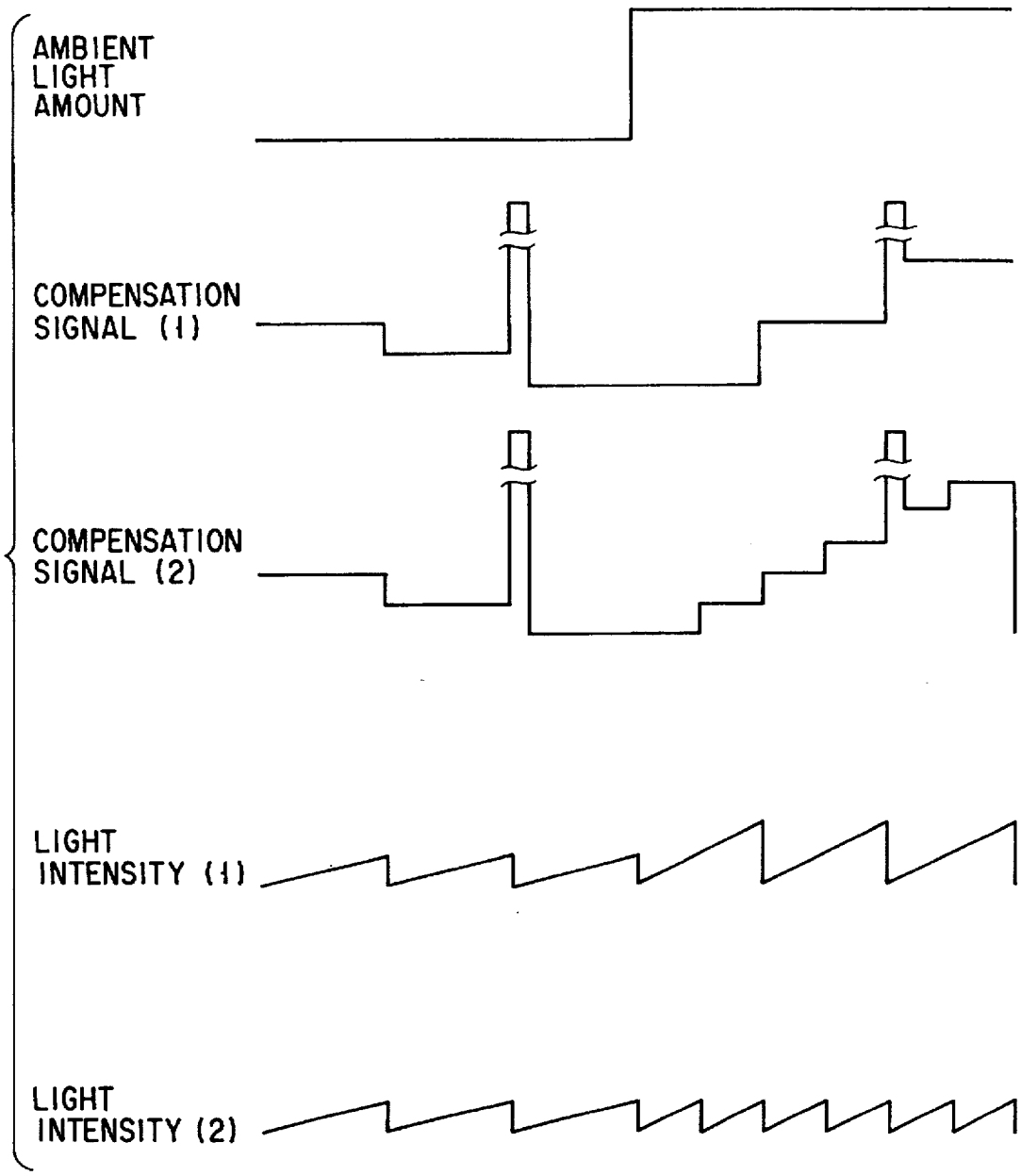
FIG. 22 is a waveform diagram showing the relationship between a compensating signal of a liquid crystal display device and light intensity according to a sixth embodiment of the present invention.

FIG. 22 is a waveform diagram showing the case (1) in which the amplitude of a compensation signal (pulse) is increased and the case (2) in which the compensation frequency is changed. In a transmission type display panel, the amount of backlight may be reduced in order to prolong the lifetime of a battery. As regards a reflection type display panel, since the amount of light is completely different in indoor and outdoor situations, it is preferable that an optimal amount of compensation be determined in accordance with the situation.

In the case (1), since the amplitude of a compensation signal is increased in accordance with the increase of the amount of light, the amount of compensation of light intensity of a liquid crystal element is also increased. In the case (2), the frequency of a compensation signal is increased in accordance with the increase in the amount of light, thereby increasing the frequency of the compensation.

Further, since the leakage is varied in a case where the temperature, instead of the amount of light, is changed, the same compensation as in the above embodiments can be achieved.

In all the above embodiments, the compensation signal Gi supplied to the capacitor element 26 has a step-shaped waveform. It is preferable that the steps of the waveform be finer, so that a compensation signal of a ramp-shaped waveform can be applied to the capacitor element.

Such an example will be described below.

(Seventh Embodiment)

Figure 23:
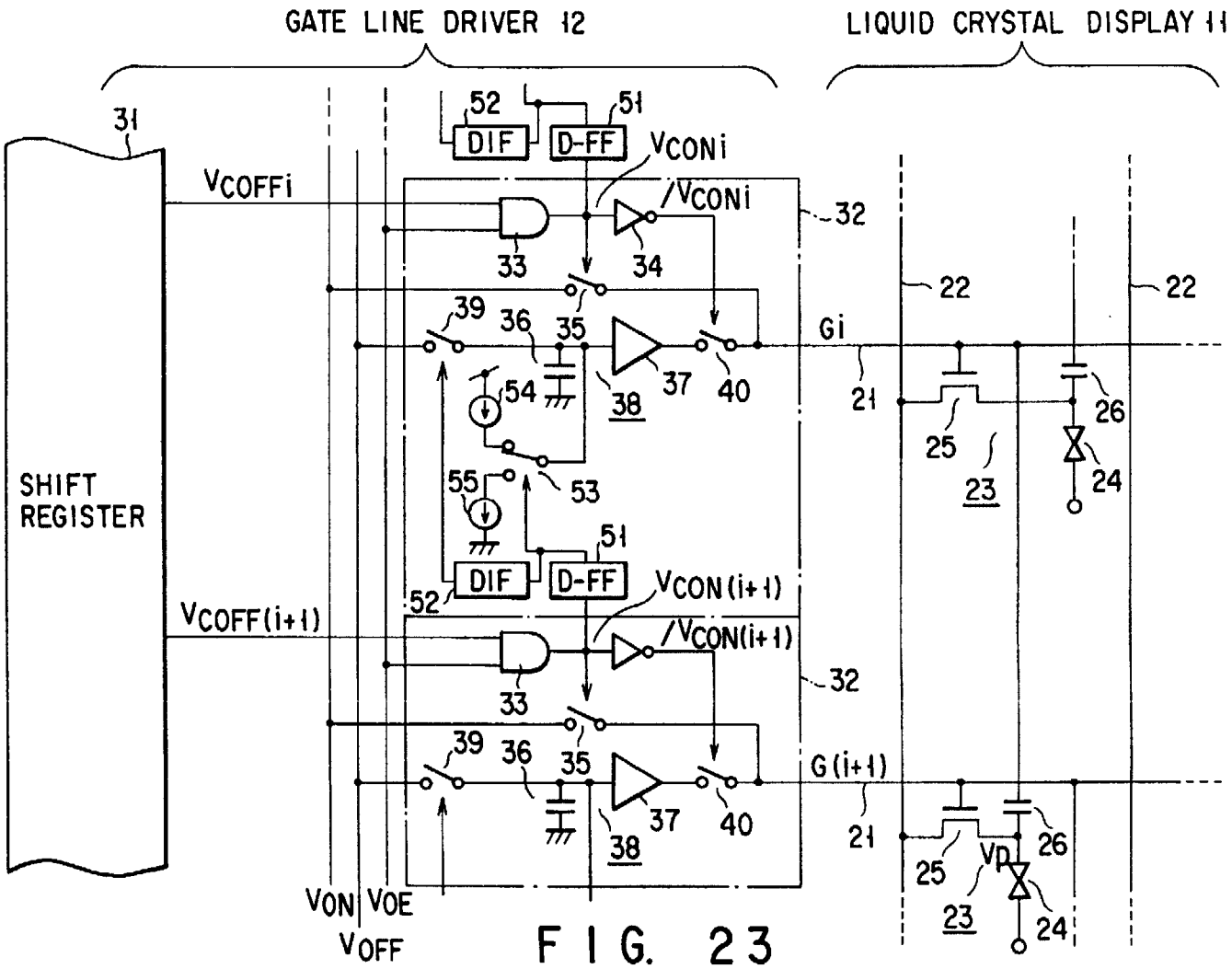
FIG. 23 is a circuit diagram showing part of the internal configuration of a gate line driver of a liquid crystal display device and part of a liquid crystal display panel according to a seventh embodiment of the present invention.

FIG. 23 is a circuit diagram showing a gate line driver and a liquid crystal display of a liquid crystal display device according to a seventh embodiment of the present invention. The gate line driver of this embodiment includes constant current sources 54 and 55 for charging a capacitor element 36. Basically, when a switch 39 is turned on, the charge stored in the capacitor element 36 is reset. Thereafter, the charge is supplied from the constant current source 54 to the capacitor element 36, and a compensation signal Gi having an upward ramp-shaped waveform as shown in FIG. 24A is output through the switch 40.

Then, a switch 53 is switched so that the charge flows inversely, from the capacitor element 36 to the constant current source 55. As a result, a compensation signal Gi having a downward ramp-shaped waveform is output. These operations are repeated, thereby generating driving signals (compensation signal) Gi and G(i+1).

A signal for switching the switch 53 is obtained from $V_{CON(i+}1)$ through a D-type flip flop 51. A signal for switching the switch 39 is a pulse synchronized with the leading edge of a pulse output from the D-type flip flop 51 and obtained by differentiating the output from the flip flop 51. A compensation source signal $V_{OFF}$, connected to an end of the switch 39, has a reference potential (e.g., ground level).

Figure 24A:
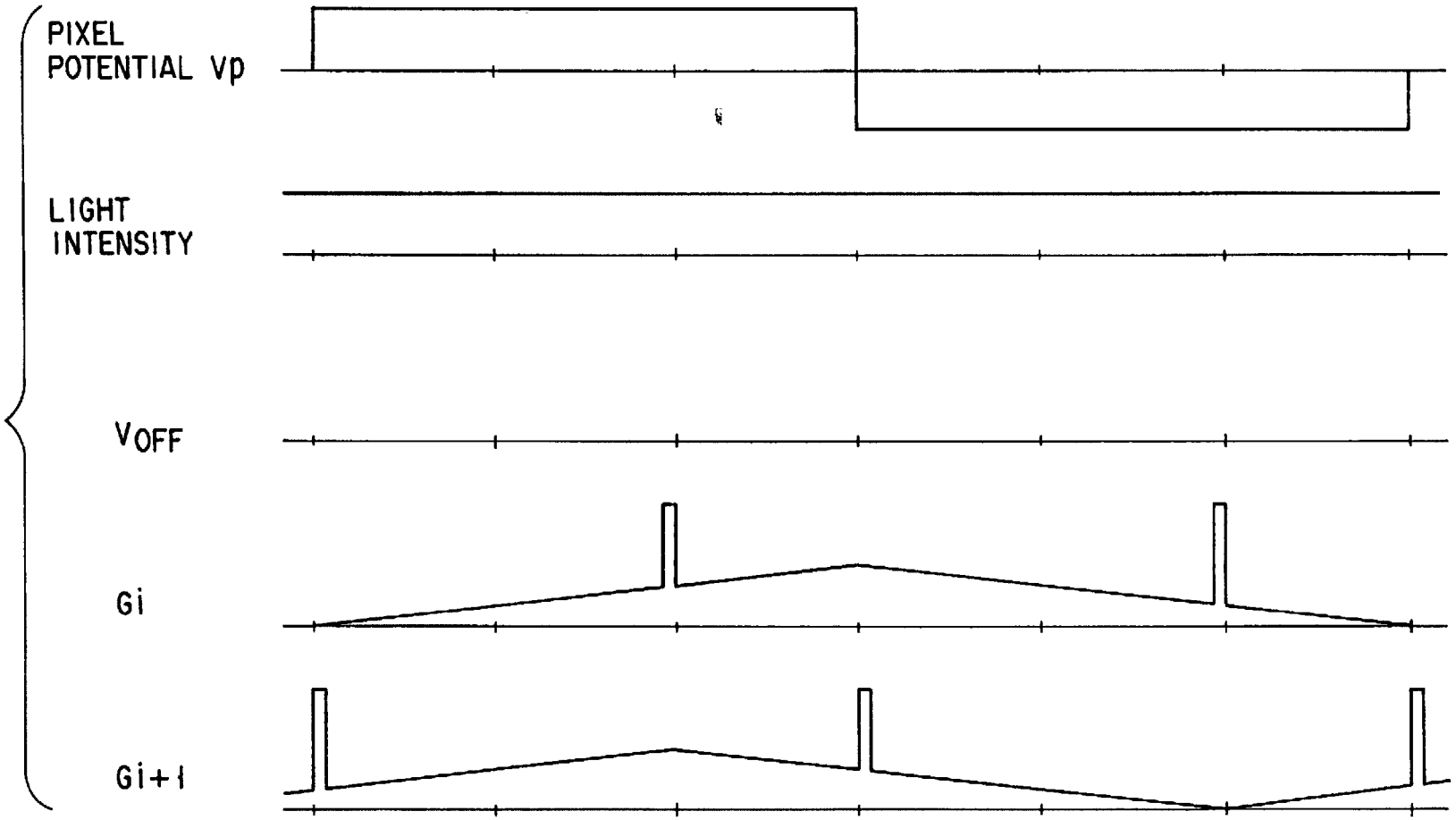
FIGS. 24A and 24B are signal waveform diagrams, on the same time axis, at portions of the liquid crystal display device according to the seventh embodiment of the present invention.
Figure 24B:
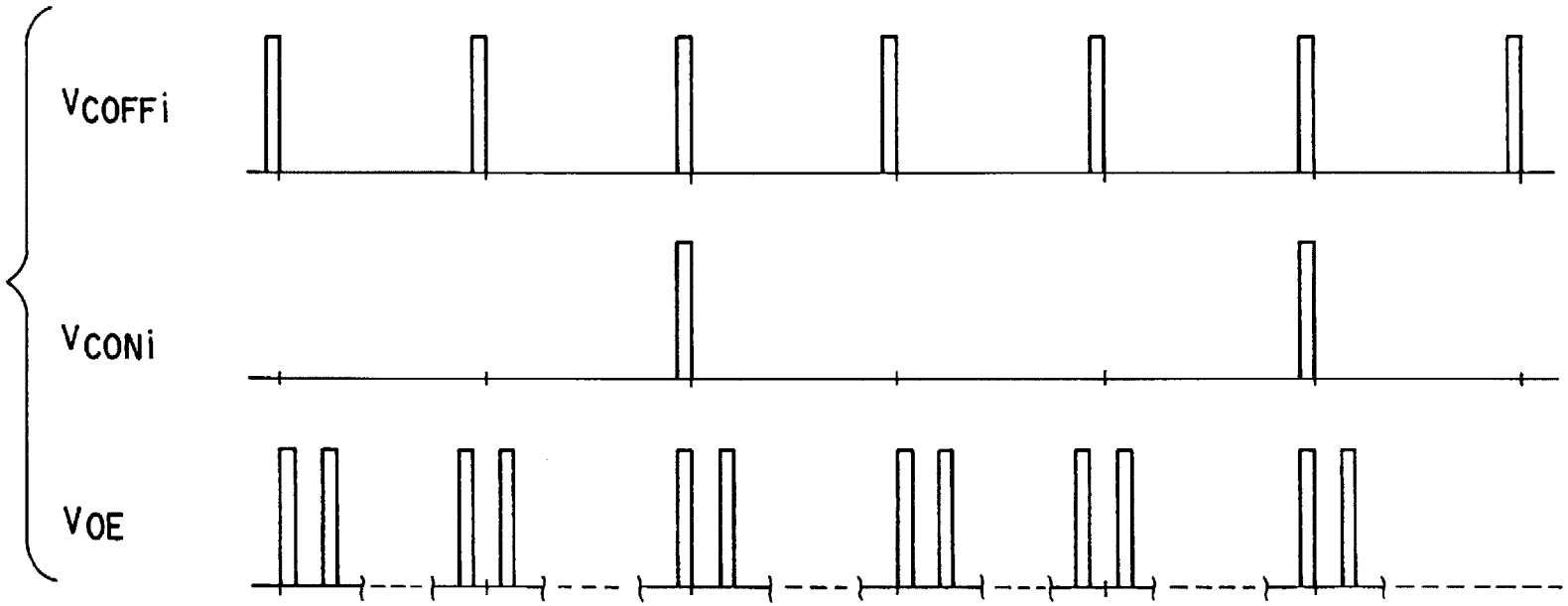

By use of the driving signal having such a waveform, the light intensity of the liquid crystal is not substantially changed, as shown in FIG. 24A. Thus, ideal compensation can be achieved.

(Eighth Embodiment)

Figure 25:
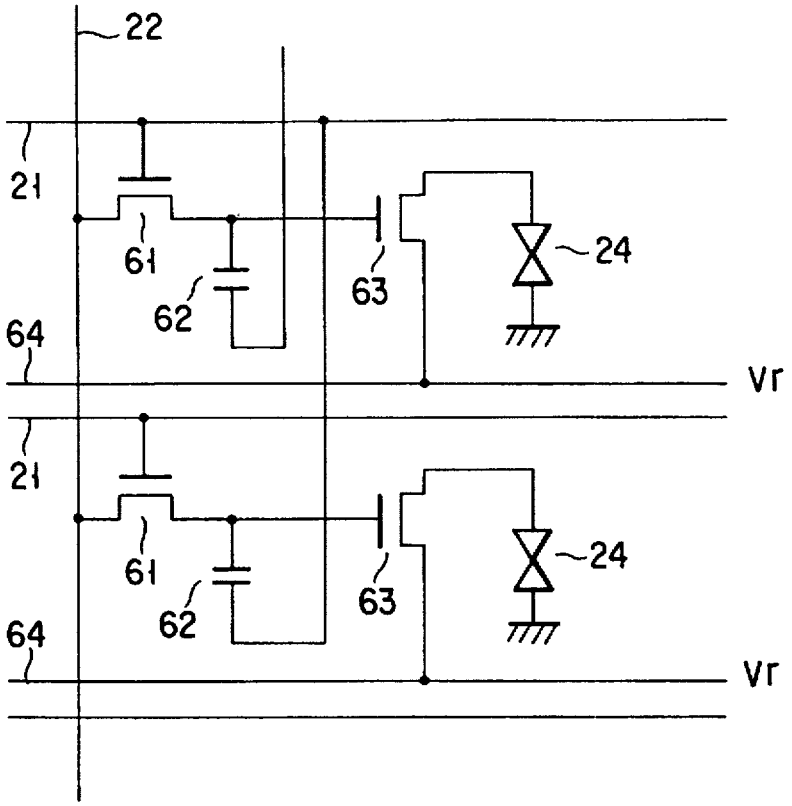
FIG. 25 is a circuit diagram of a liquid crystal panel of a liquid crystal display device according to an eighth embodiment of the present invention.

An embodiment, in which the present invention is applied to a pixel having the DRAM structure, will now be described. FIG. 25 is a circuit diagram showing the structure of a liquid crystal display panel according to an eighth embodiment of the present invention. Referring to FIG. 25, an image signal is temporarily stored in a capacitor element 62 through a transistor 61. By turning on or off a transistor 63, an alternating current signal $V_r$ supplied through a drive line 64 is applied to a liquid crystal element 24, as divisional voltages of resistors of the transistor 63 and the liquid crystal element 24. In this case, the image signal is varied due to leakage of the transistor 61, and a compensating step-shaped pulse is supplied to the capacitor element 62 in a voltage holding period, thereby maintaining the holding voltage. In this case, as in the first embodiment, the capacitor element is connected to the preceding gate line 21, it can receive a compensation signal in the same manner as in the first embodiment.

Figure 26:
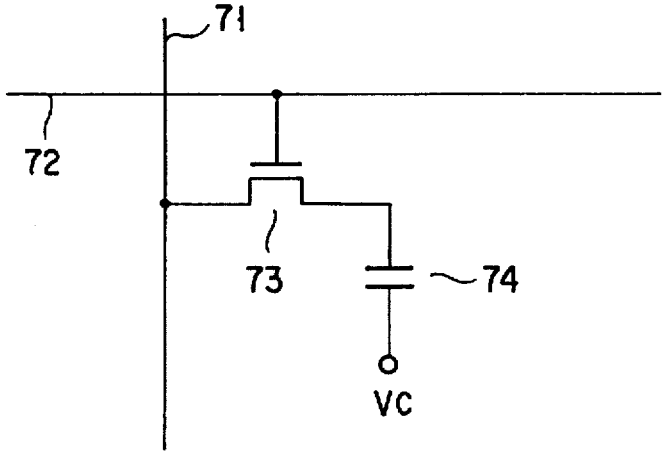
FIG. 26 is a circuit diagram for explaining a case in which a method for compensating a charge stored in a capacitor element of the present invention is applied to a DRAM.

The present invention, as a method for compensating a charge stored in a capacitor element, can be applied to a DRAM of a semiconductor memory device. FIG. 26 shows an equivalent circuit of one DRAM element, in which one of the source and drain of a switching transistor 73 is connected to a bit line 71 and the other is connected to a capacitor element 74. The gate electrode of the transistor 73 is connected to a word line 72. In this case, an image signal stored in the capacitor element 74 is leaked owing to a signal supplied through the bit line 71. In general, refreshment is repeated periodically to recharge the capacitor element a number of times, which increases power consumption. To overcome this drawback, a step-shaped compensation signal or a ramp-shaped compensation signal, which varies linearly, is input to the DRAM through a terminal $V_c$ of the capacitor element. As a result, the holding time can be apparently prolonged.

The compensating method can be applied to any type of semiconductor memory comprising at least a switch and a capacitor element, for example, amorphous silicon and monocrystalline semiconductor memories involving leakage.

The present invention is not limited to the above embodiments, but can be variously modified. The display device is not limited to a liquid crystal display device, but can be a plasma display device, an electroluminescence device, and so on.

As has been described above, according to the present invention, even if the leak characteristics of a pixel is the same as those in the prior art, the amount of flicker can be reduced. In addition, when the frequency of the flickers is increased, a low-pass filter effect is obtained by a bad response characteristic of the display element, thereby making the flickers invisible. Thus, the flickers can be further reduced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A display device comprising:

a substrate;

a plurality of address lines arranged in a horizontal direction on the substrate;

a plurality of signal lines, arranged in a vertical direction on the substrate, for transmitting an image signal;

a plurality of pixels, arranged in a matrix at intersections between the plurality of address lines and the plurality of signal lines on the substrate, each pixel including a display element, and a switch element which is connected between a corresponding one of the plurality of signal lines and the display element and which is controlled to be on or off by a corresponding one of the plurality of address lines; and compensating means for supplying, through the corresponding one of the plurality of address lines to the display element, a compensation signal for compensating a change in potential, the potential being applied to the display element while the switch element is controlled to be on, in a period between just after the switch element is controlled to be off and before the switch element is controlled to be on again, in order to compensate the chance in the potential.

2. The display device according to claim 1, wherein the compensating means output as the compensation signal, a signal having a potential which varies stepwise in one of positive and negative directions with a lapse of time in the period in which the switch element is controlled to be off.

3. The display device according to claim 1, wherein the compensating means output as the compensation signal, a signal having a potential which varies linearly in one of positive and negative directions with a lapse of time.

4. The display device according to claim 1, wherein the compensating means output as the compensation signal, a signal having a potential which varies in accordance with at least one of a polarity of the image signal supplied to the corresponding one of the signal lines, a potential thereof, and a position of the pixel in the matrix.

5. The display device according to claim 2, wherein the compensating means output as the compensation signal, a signal having a cyclic period of about 1/n (n=an integer ≧2) of that of a signal for driving the switch element.

6. The display device according to claim 3, wherein the compensating means output as the compensation signal, a signal having a cyclic period of about 1/n (n=an integer ≧2) of that of a signal for driving the switch element.

7. The display device according to claim 2, further comprising driver circuits for driving the plurality of address lines, each of the driver circuits including a sample-hold circuit for maintaining a value of the compensation signal to be stepwise.

8. The display device according to claim 1, wherein the compensating means output as the compensation signal, a signal in which at least one of an absolute value of the potential applied to the display element and a period of change of the potential is varied in accordance with an amount of light applied to the switch element.

9. The display device according to claim 1, wherein the compensating means output as the compensation signal, a signal in which at least one of an absolute value of the potential applied to the display element and a period of change of the potential is varied in accordance with a period in which the switch element is driven.

10. The display device according to claim 1, wherein each of the pixels further comprises a capacitor element connected to the display element to store the image signal and a capacitor line for applying a potential to the capacitor element, and the compensating means supply the compensation signal to the capacitor line.

11. The display device according to claim 10, wherein the capacitor line is connected to one of the plurality of address lines, which is assigned to one of the plurality of pixels adjacent in the vertical direction.

12. A liquid crystal display device comprising:

a substrate;

a plurality of pixels arranged in rows and columns on the substrate, each of the pixels including a liquid crystal display element having a first and a second electrode, a capacitor element having a first and a second terminal and a switch element for selecting the liquid crystal display element, the switch element including a conductive path having a first and a second terminal and a control electrode for controlling a conduction state of the conductive path, wherein the first terminal of the switch element is connected to the first electrode of the liquid crystal display element and the first terminal of the capacitor element, and the second terminal of the capacitor element is connected to the control electrode of a switch element adjacent in a row direction;

a plurality of address lines arranged in the row direction on the substrate, each of the address lines being connected to the control electrode of the switch element of each of the plurality of pixels arranged along the address lines;

a plurality of signal lines arranged in a column direction on the substrate, each of the signal lines being connected to the second terminal of the conductive path of each of the plurality of pixels arranged along the signal lines and supplying an image signal to the liquid crystal display element through the switch element; and an address line driver for selectively driving the plurality of address lines, wherein the address line driver comprises compensation signal supplying means for performing an interlaced driving operation for selecting desired ones of the address lines separated from one another with a predetermined number of address lines interposed therebetween, the interlaced driving operation dividing one frame into a predetermined number of fields, and for supplying a compensation signal for compensating a change in potential, the potential being applied to the liquid crystal display element while the switch element is controlled to be on, to one of the address lines which is adjacent in the row direction and is coupled to the control electrode of the switch element adjacent in the row direction, the control electrode being connected to the second terminal of the capacitor element, in a period between just after the switch element of each of the plurality of pixels connected to one of the desired address lines is controlled to be off and before the same is controlled to be on again, in order to compensate the change in the potential.

13. The liquid crystal display device according to claim 12, wherein the address line driver further comprises:

a plurality of address signal generating means for generating an address signal corresponding to the plurality of address lines;

address signal selecting means for determining an address signal to be driven, based on the address signal and an interlace selection signal supplied from an external device; and compensation signal generating means for generating the compensation signal from the address signal and a compensation source signal supplied from an external device.

14. The liquid crystal display device according to claim 13, wherein the compensation signal generating means includes sample-hold means for sample-holding in synchronization with the address signal a voltage of the compensation source signal, having an absolute value which varies linearly every frame with a lapse of time, and outputting a step-like signal as the compensation signal.

15. The liquid crystal display device according to claim 12, wherein the compensation signal supplying means output, as the compensation signal, a signal which is varied greatly in one field, in a case where the image signal supplied to the signal line in a preceding field has a polarity the same as that of a pixel signal applied to the liquid crystal display element, and varied little in one field, in a case where the image signal supplied to the signal line in a preceding field has a polarity opposite to that of a pixel signal applied to the liquid crystal display element.

16. The liquid crystal display device according to claim 12, wherein each of the plurality of signal lines supplies, as the image signal, a signal whose polarity is varied every field, to the liquid crystal display element.

17. The liquid crystal display device according to claim 12, wherein the compensation signal supplying means output, as the compensation signal, a signal having an absolute value which varies linearly with a lapse of time, and a potential of the pixel is maintained to be substantially constant in each frame.

18. A liquid crystal display device comprising:

a substrate;

a plurality of pixels arranged in rows and columns on the substrate, each of the pixels including a liquid crystal display element having a first and a second electrode, a capacitor element having a first and a second terminal and a switch element for selecting the liquid crystal display element, the switch element including a conductive path having a first and a second terminal and a control electrode for controlling a conduction state of the conductive path, wherein the first terminal of the switch element is connected to the first electrode of the liquid crystal display element and the first terminal of the capacitor element, and the second terminal of the capacitor element is connected to the control electrode of the switch element in an adjacent one of the pixels in a row direction;

a plurality of address lines arranged in the row direction on the substrate, each of the address lines being connected to the control electrode of the switch element of each of the plurality of pixels arranged along the address lines; and a plurality of signal lines arranged in a column direction on the substrate, each of the signal lines being connected to the second terminal of the conductive path of each of the plurality of pixels arranged along the signal lines and supplying an image signal to the liquid crystal display element through the switch element, wherein the image signal is cyclically applied to the liquid crystal display element at a predetermined period by means of the switch; and a compensation signal is superimposed on each of the address lines, to compensate a change in potential of the liquid crystal display element, which has been applied while the control gate of the switch is controlled to be on, and is cyclically applied every about 1/n (n=an integer which is equal to two or more) of the predetermined period, in a period between just after the switch is controlled to be off and before the switch is controlled to be on again.

19. A liquid crystal display device comprising:

a substrate;

a plurality of pixels arranged in rows and columns on the substrate, each of the pixels including a liquid crystal display element having a first and a second electrode, a capacitor element having a first and a second terminal and a switch element for selecting the liquid crystal display element, the switch element including a conductive path having a first and a second terminal and a control electrode for controlling a conduction state of the conductive path, wherein the first terminal of the switch element is connected to the first electrode of the liquid crystal display element and the first terminal of the capacitor element;

a plurality of capacitor lines formed on the substrate, each connected to the second terminal of the capacitor element;

a plurality of address lines arranged in the row direction on the substrate, each of the address lines being connected to the control electrode of the switch element of each of the plurality of pixels arranged along the address lines;

a plurality of signal lines arranged in a column direction on the substrate, each of the signal lines being connected to the second terminal of the conductive path of the switch element of each of the plurality of pixels arranged along the signal lines and supplying an image signal to the liquid crystal display element through the switch element; and an address line driver for selectively driving the plurality of address lines, wherein each of the capacitor lines supplies a compensation signal for compensating a change in potential of the liquid crystal element, the potential having been applied to the liquid crystal display element while the control gate of the switch is controlled to be on, in a period between just after the switch element is controlled to be off and before the switch is controlled to be on again, in order to compensate the change in the potential.

20. A liquid crystal display device comprising:

a substrate;

a plurality of address lines arranged in a horizontal direction on the substrate;

a plurality of signal lines, arranged in a vertical direction on the substrate, for transmitting an image signal;

a plurality of pixels, arranged on the substrate at intersections between odd number-th address lines counted from an end of the plurality of address lines and odd number-th signal lines counted from an end of the plurality of signal lines, and intersections between even number-th address lines counted from the end of the plurality of address lines and even number-th signal lines counted from the end of the plurality of signal lines, each pixel including a display element, and a switch element which is connected between a corresponding one of the plurality of signal lines and the display element and which is controlled to be on or off under control of a corresponding one of the plurality of address lines; and compensating means for supplying, through the corresponding one of the plurality of address lines to the display element, a compensation signal for compensating a change in potential applied to the display element.

21. The liquid crystal display device according to claim 20, wherein the plurality of signal lines supply, as the image signal, signals having polarities, which are different from each other in adjacent lines and inverted every screen.

22. The liquid crystal display device according to claim 20, wherein the compensating means output as the compensation signal, a signal having a potential which varies stepwise in one of positive and negative directions with a lapse of time in a period in which the switch element is controlled to be off, in order to compensate the change in the potential applied to the display element in a period in which the switch element is controlled to be on.

23. The liquid crystal display device according to claim 20, wherein the compensating means output as the compensation signal, a signal having a potential which varies linearly in one of positive and negative directions with a lapse of time.

24. The liquid crystal display device according to claim 20, wherein the compensating means output as the compensation signal, a signal having a potential which varies in accordance with at least one of a polarity of the image signal supplied to the corresponding one of the signal lines, a potential thereof, and a position of the pixel in the matrix.

25. The liquid crystal display device according to claim 22, wherein the compensating means output as the compensation signal, a signal having a period of about 1/n (n=an integer ≧2) of that of a signal for driving the switch element.

26. The liquid crystal display device according to claim 23, wherein the compensating means output as the compensation signal, a signal having a period of about 1/n (n=an integer ≧2) of that of a signal for driving the switch element.

27. The liquid crystal display device according to claim 22, further comprising driver circuits for driving the plurality of address lines, each of the driver circuits including a sample-hold circuit for maintaining a value of the compensation signal to be stepwise.

28. The liquid crystal display device according to claim 20, wherein the compensating means output as the compensation signal, a signal in which at least one of an absolute value of the potential applied to the display element and a period of change of the potential is varied in accordance with an amount of light applied to the switch element.

29. The liquid crystal display device according to claim 20, wherein the compensating means output as the compensation signal, a signal in which at least one of an absolute value of the potential applied to the display element and a period of change of the potential is varied in accordance with a period in which the switch element is driven.

30. The liquid crystal display device according to claim 20, wherein each of the pixels further comprises a capacitor element connected to the display element to store the image signal and a capacitor line for applying a potential to the capacitor element, and the compensating means supply the compensation signal to the capacitor line.

31. The liquid crystal display device according to claim 30, wherein the capacitor line is connected to one of the plurality of address lines, which is assigned to one of the plurality of pixels adjacent in the vertical direction.

32. A liquid crystal display device comprising:

a substrate;

a plurality of pixels arranged in rows and columns on the substrate, each of the pixels including a liquid crystal display element having a first and a second electrode, a capacitor element having a first and a second terminal, a first and a second switch element for selecting the liquid crystal display element, each of the first and the second switch element including a conductive path having a first and a second terminal and a control electrode for controlling a conduction state of the conductive path, wherein the first terminal of the first switch element is connected to the control electrode of the second switch element and the first terminal of the capacitor element, and the first terminal of the second switch element is connected to the first electrode of the liquid crystal display element;

a plurality of capacitor lines formed on the substrate, each connected to the second terminal of the capacitor element;

a plurality of liquid crystal element driving lines formed on the substrate, each connected to the second terminal of the second switch element;

a plurality of address lines arranged in the row direction on the substrate, each of the address lines being connected to the control electrode of the first switch element of each of the plurality of pixels arranged along the address lines;

a plurality of signal lines arranged in a column direction on the substrate, each of the signal lines being connected to the second terminal of the conductive path of the first switch element of each of the plurality of pixels arranged along the signal lines and supplying an image signal to the liquid crystal element through the first switch element; and an address line driver for selectively driving the plurality of address line, wherein each of the capacitor lines supplies a compensation signal for compensating a change in potential applied to the liquid crystal display element.

33. The liquid crystal display device according to claim 32, wherein each of the capacitor lines is connected to one of the plurality of address lines adjacent in the vertical direction.

* * * * *

UNITED STATES PATENT AND TRADEMARK OFFICE

CERTIFICATE OF CORRECTION

PATENT NO. : 5,748,169

DATED : MAY 5, 1998

INVENTOR(S) : Haruhiko OKUMURA ET AL.

It is certified that error appears in the above-identified patent and that said Letters Patent is hereby corrected as shown below:

Column 17, line 7, change "chance" to --change--.

Signed and Sealed this

Second Day of November, 1999

*Attest:*

*Attesting Officer*

Q. TODD DICKINSON

*Acting Commissioner of Patents and Trademarks*